US011254536B2

(12) United States Patent
Noda et al.

(10) Patent No.: US 11,254,536 B2
(45) Date of Patent: Feb. 22, 2022

(54) IMAGE FORMING APPARATUS

(71) Applicant: CANON KABUSHIKI KAISHA, Tokyo (JP)

(72) Inventors: Shinya Noda, Mishima (JP); Kenichirou Isobe, Yokohama (JP); Kenji Ninomiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 197 days.

(21) Appl. No.: 16/599,443

(22) Filed: Oct. 11, 2019

(65) Prior Publication Data

US 2020/0122951 A1 Apr. 23, 2020

(30) Foreign Application Priority Data

Oct. 19, 2018 (JP) ..... JP2018-197222
Oct. 19, 2018 (JP) ..... JP2018-197223

(51) Int. Cl.
*B65H 31/22* (2006.01)
*B65H 31/02* (2006.01)

(52) U.S. Cl.
CPC ..... *B65H 31/22* (2013.01); *B65H 31/02* (2013.01); *B65H 2402/10* (2013.01)

(58) Field of Classification Search
CPC ..... B65H 2405/351; B65H 2405/12
See application file for complete search history.

(56) References Cited

U.S. PATENT DOCUMENTS 5,493,380 A 2/1996 Saitou et al.
6,527,267 B1 3/2003 Kuwata et al.
6,643,480 B2 11/2003 Kuwata et al.
6,661,995 B2 12/2003 Isobe et al.
6,882,823 B2 * 4/2005 Matsuyama ..... G03G 15/232 399/110
6,912,044 B2 6/2005 Sekiyama et al.
6,973,285 B2 12/2005 Sekiyama et al.
8,191,884 B2 6/2012 Sato et al.
8,328,193 B2 12/2012 Ninomiya
8,342,509 B2 1/2013 Takiguchi et al.
8,511,671 B2 8/2013 Takiguchi et al.
(Continued)

FOREIGN PATENT DOCUMENTS

CN 102020137 A 4/2011
CN 102649517 A 8/2012
(Continued)

OTHER PUBLICATIONS

Oct. 2021 Chinese Official Action in Chinese Patent Appln. No. 201910992138.7.

*Primary Examiner* — Jennifer Bahls
(74) *Attorney, Agent, or Firm* — Venable LLP

(57) ABSTRACT

An image forming apparatus includes an image forming portion, a swingable member feeding portion, a sheet stacking portion including a stacking tray and a sheet feeding passage and movable between a first position where a sheet feed from the feeding portion is feedable to the sheet feeding passage and a second position away from the first position, and a movable member movable to a space, between the feeding portion and the stacking portion, generating with movement of the stacking portion from the first position to the second position in interrelation with the movement of the stacking portion from the first position to the second position.

26 Claims, 28 Drawing Sheets

(56) References Cited

U.S. PATENT DOCUMENTS

| | | | | |
|---|---|---|---|---|
| 8,672,313 | B2 | 3/2014 | Fukami | |
| 9,359,159 | B2 | 6/2016 | Noda et al. | |
| 10,543,999 | B2 | 1/2020 | Furukawa et al. | |
| 2002/0114634 | A1* | 8/2002 | Ahn | G03G 15/234 399/13 |
| 2005/0141939 | A1* | 6/2005 | Kayama | B65H 43/06 399/405 |
| 2010/0072692 | A1 | 3/2010 | Iida et al. | |
| 2011/0062646 | A1 | 3/2011 | Sato et al. | |
| 2012/0217693 | A1 | 8/2012 | Fukami | |
| 2017/0240376 | A1* | 8/2017 | Shirasaki | B65H 37/04 |

FOREIGN PATENT DOCUMENTS

| | | | |
|---|---|---|---|
| JP | H10-095566 | A | 4/1998 |
| JP | 2001-253585 | A | 9/2001 |
| JP | 2011-037591 | A | 2/2011 |
| JP | 2012-034956 | A | 2/2012 |
| JP | 2012-035956 | A | 2/2012 |
| JP | 2012-051685 | A | 3/2012 |
| JP | 2014-106294 | A | 6/2014 |
| JP | 2015-147663 | A | 8/2015 |

* cited by examiner (a)

(b)

(a)

(b)

(a)

(b)

IMAGE FORMING APPARATUS

FIELD OF THE INVENTION AND RELATED ART

The present invention relates to an image forming apparatus, such as a copying machine or a printer, for forming an image on a sheet.

In recent years, in the image forming apparatus, such as the copying machine or the printer, for forming the image on the sheet, in order to meet a demand for downsizing, component parts are provided inside a casing of the image forming apparatus so as not to form a dead space. As a result, a sheet feeding passage is disposed in the neighborhood of a center of the casing of the image forming apparatus, and when the sheet jams in the feeding passage in the neighborhood of the center of the casing of the image forming apparatus, it becomes difficult for an operator to put his (her) hand(s) into a spacing to the neighborhood of the center of the casing of the image forming apparatus.

Therefore, in an image forming apparatus disclosed in Japanese Laid-Open Patent Application (JP-A) 2001-253585, a constitution in which a feeding guide forming a feeding passage in the neighborhood of a center of a casing of the image forming apparatus is provided so as to be capable of being pulled out to an outside of the casing of the image forming apparatus has been proposed. As a result, the feeding guide is pulled out to the outside of the apparatus casing and thus an operation region is ensured in the outside of the apparatus casing, so that the sheet can be removed.

Further, in the image forming apparatus, such as the copying machine or the printer, for forming the image on the sheet, a constitution in which a stacking portion for stacking the sheet on which the image is formed is provided movably at an upper portion of the image forming apparatus with respect to a vertical direction has been known (JP-A 2014-106294). The image forming apparatus disclosed in JP-A 2014-106294 includes the stacking portion for stacking the sheet on which the image is formed, and the stacking portion is formed in an independent unit in the image forming apparatus and is provided movably so that the independent unit is capable of being connected to and moved away from a part of the image forming apparatus. Further, the part of the image forming apparatus includes a first discharging portion for discharging the sheet to the upper portion of the independent unit and a second discharging portion for discharging the sheet toward a processing portion provided inside the independent unit and below the stacking portion.

The independently movable unit in the image forming apparatus is capable of being connected to the first and second discharging portions or is capable of being moved away from the first and second discharging portions. At a position where the independent unit is connected to the first and second discharging portions, the sheet discharged through the first discharging portion can be stacked on the stacking portion and the sheet discharged through the second discharging portion can be fed to the processing portion.

In the above-described image forming apparatus, in the case where the sheet jammed in a feeding passage in the neighborhood of each of a connecting portion between the independent unit and the first discharging portion and a connecting portion between the independent unit and the second discharging portion, there is a need to perform a jam clearance operation for removing the jammed sheet. In this case, there is a need to perform an operation in which the feeding passage is opened by moving the independent unit is moved in a direction of being moved away from the first discharging portion and the second discharging portion.

SUMMARY OF THE INVENTION

A principal object of the present invention is to provide an image forming apparatus capable improving operativity of a process of removing a sheet jammed in the neighborhood of a connecting portion between a discharging portion and a movable stacking portion which are provided to the image forming apparatus.

According to an aspect of the present invention, there is provided an image forming apparatus comprising: an image forming portion configured to form an image on a sheet; a feeding portion configured to feed the sheet on which the image is formed; a stacking portion including a stacking tray configured to stack the sheet discharged from the feeding portion and a sheet feeding passage along which the sheet fed from the feeding portion is fed, and movable between a first position where the sheet feed from the feeding portion is feedable to the sheet feeding passage and a second position away from the first position; and a movable member movable to a space, between the feeding portion and the stacking portion, generating with movement of the stacking portion from the first position to the second position in interrelation with the movement of the stacking portion from the first position to the second position.

Further features of the present invention will become apparent from the following description of exemplary embodiments with reference to the attached drawings.

Figure 2:
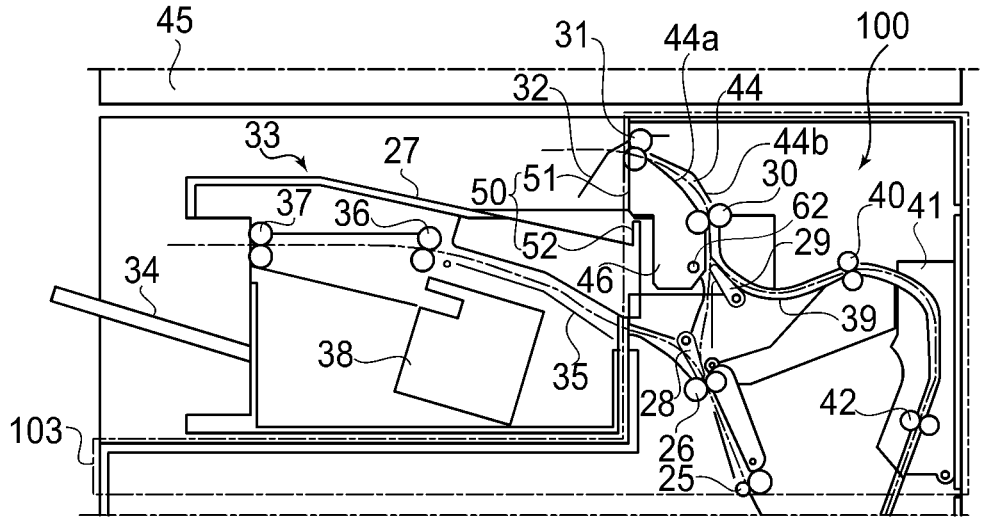
Figure 2:
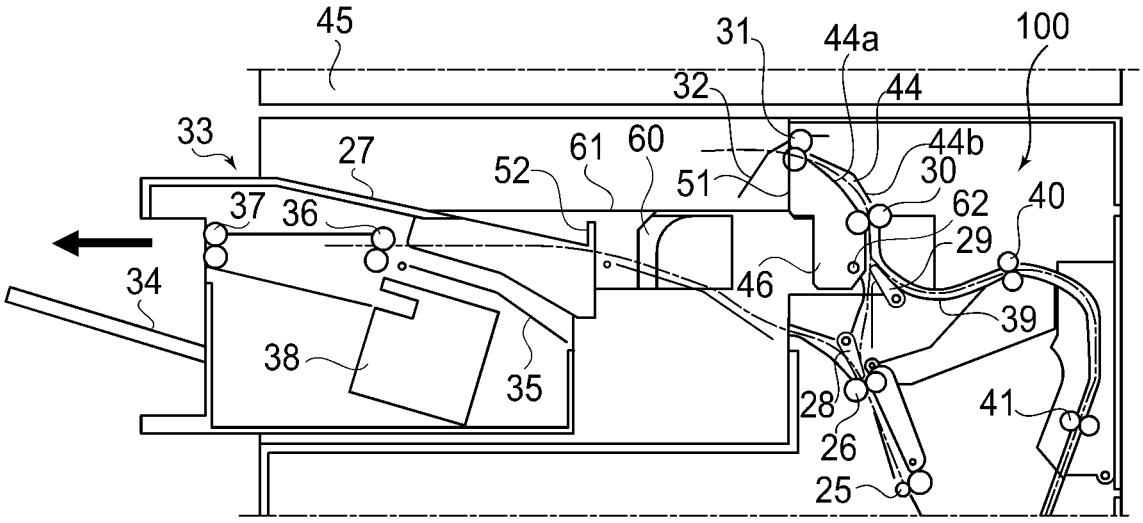

Parts (a) and (b) of FIG. 2 are illustrations of (slide) movement of a sheet processing device in the embodiment 1.

Figure 3:
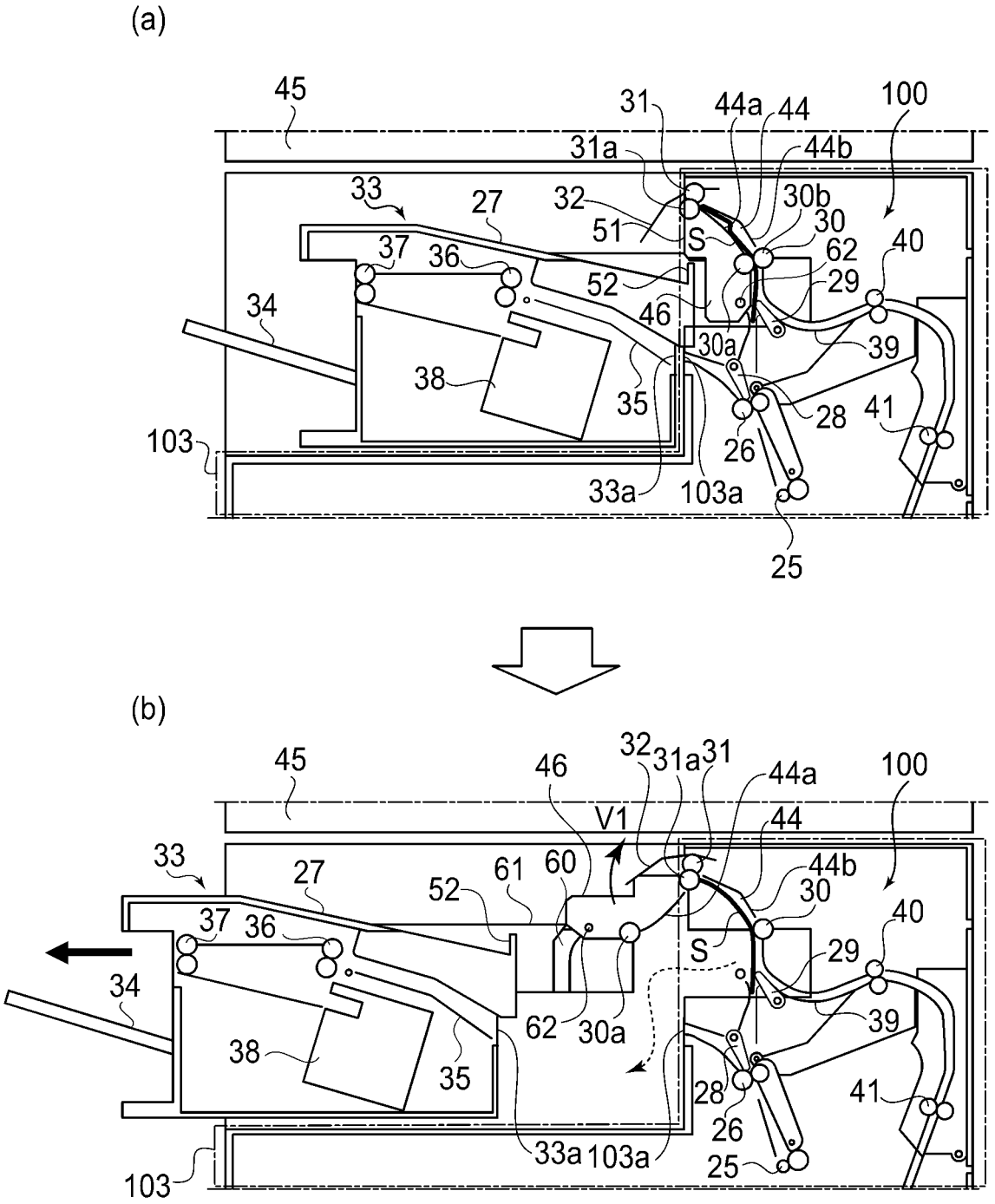

Parts (a) and (b) of FIG. 3 are illustrations of an opening and closing operation of a feeding unit on an apparatus main assembly side in the embodiment 1.

Figure 4:
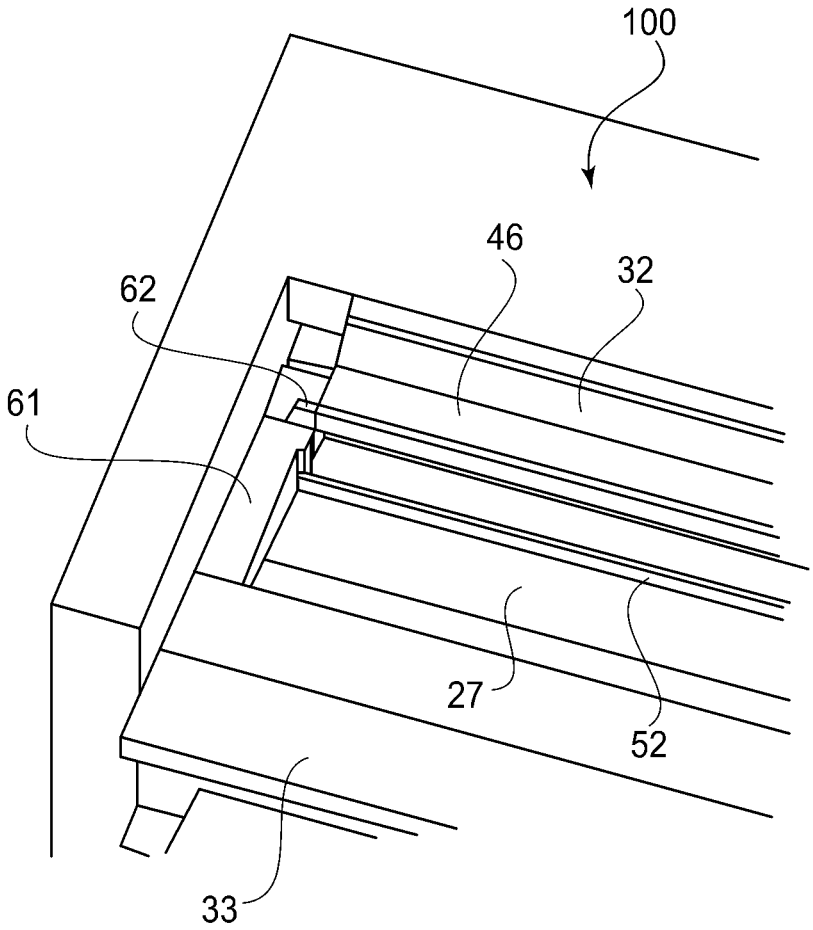

FIG. 4 is a perspective view of the sheet processing device and the feeding unit in the embodiment 1.

Figure 5:
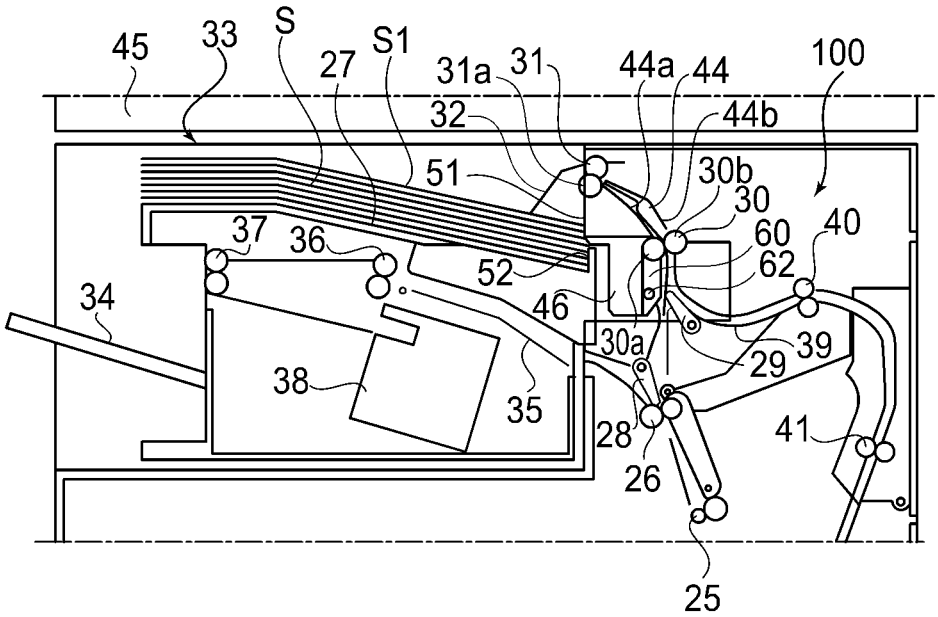

FIG. 5 is an illustration of an opening and closing operation of the sheet processing device and the feeding unit in the embodiment 1.

Figure 6:
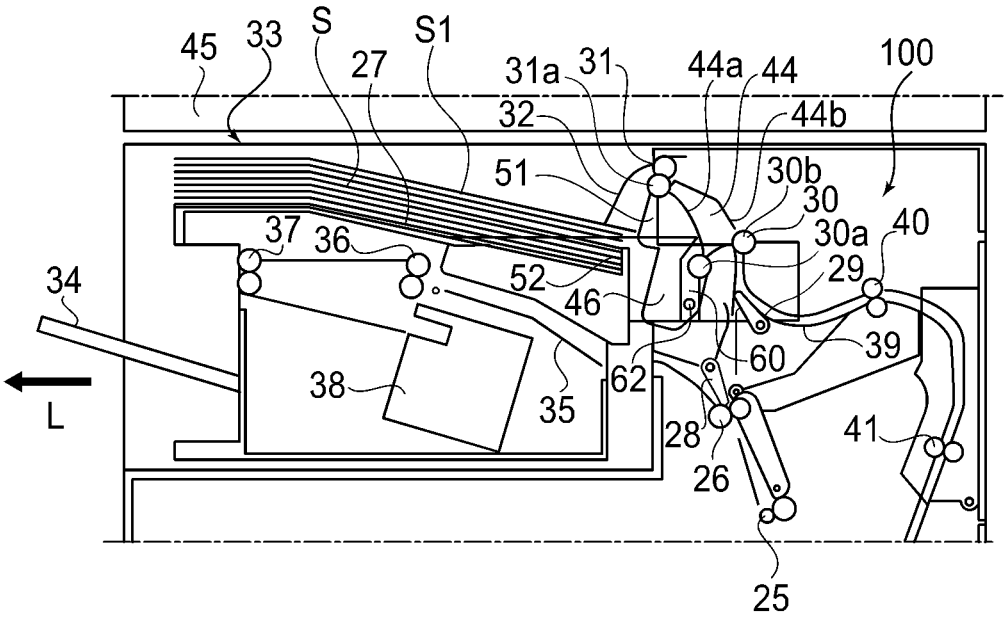

FIG. 6 is an illustration of the opening and closing operation of the sheet processing device and the feeding unit in the embodiment 1.

Figure 7:
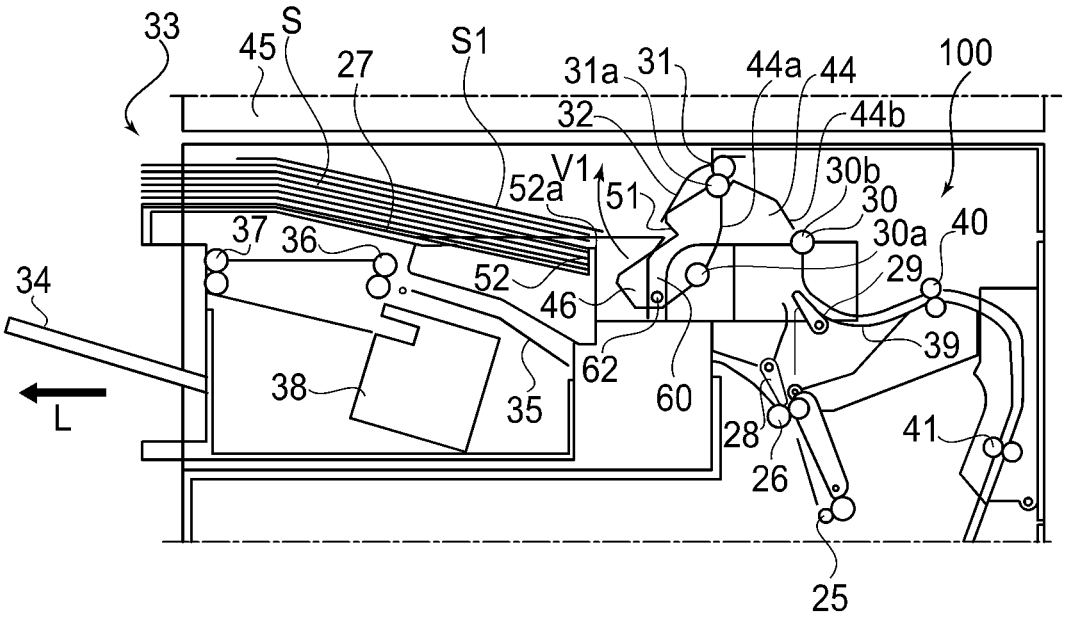

FIG. 7 is an illustration of the opening and closing operation of the sheet processing device and the feeding unit in the embodiment 1.

Figure 8:
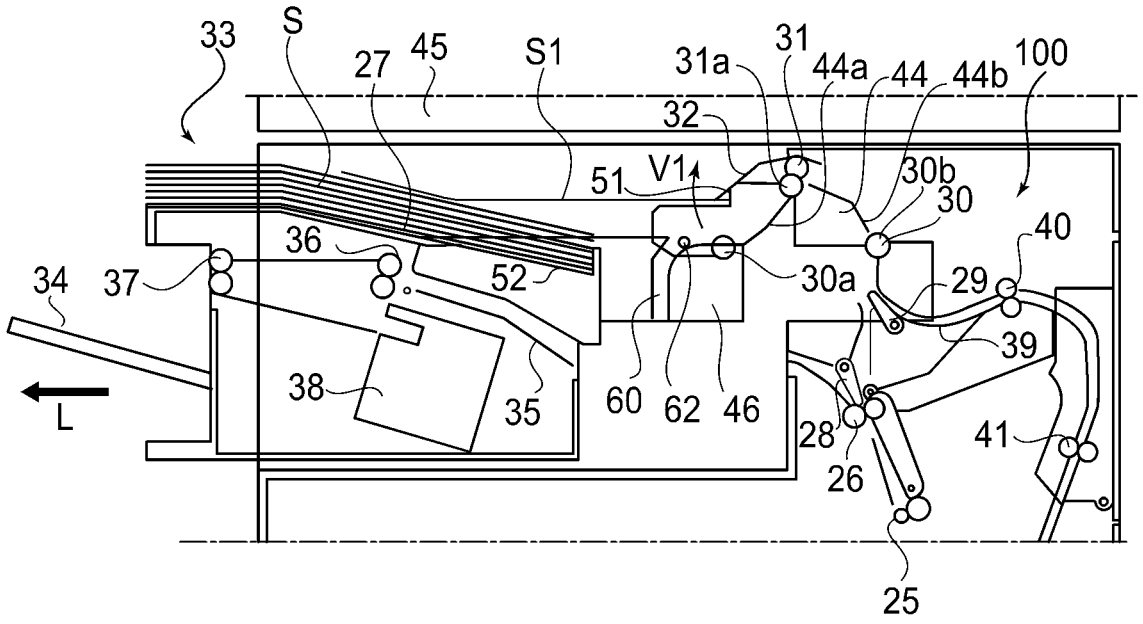

FIG. 8 is an illustration of the open and closing operation of the sheet processing device and the feeding unit in the embodiment 1.

Figure 9:
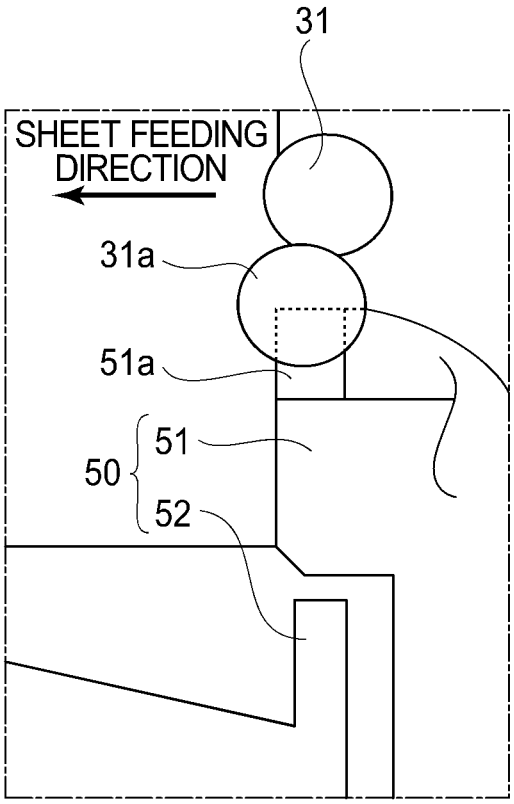

FIG. 9 is an illustration of a positional relationship among a discharging roller pair, an upper stacking wall and a lower stacking wall with respect to a sheet feeding direction.

Figure 10:
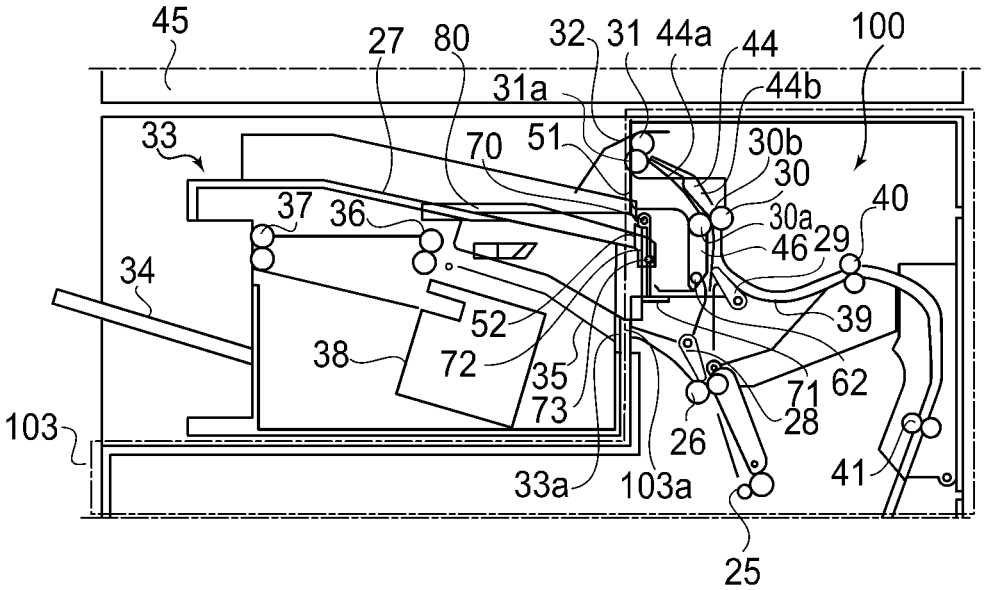

FIG. 10 is a schematic view of an image forming apparatus in an embodiment 2.

Figure 11:
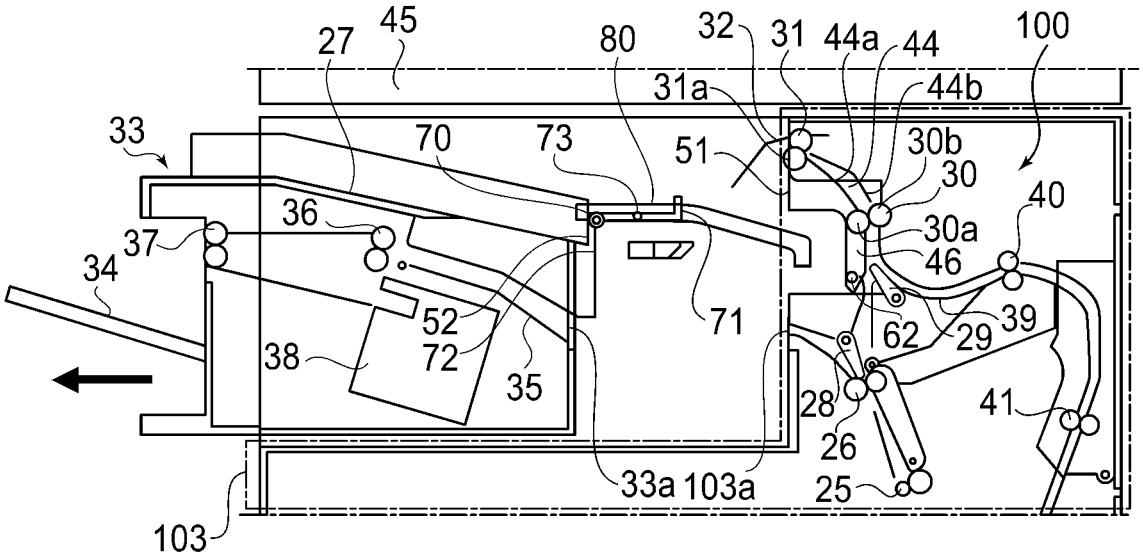

FIG. 11 is an illustration of (slide) movement of a sheet processing device in the embodiment 2.

Figure 12:
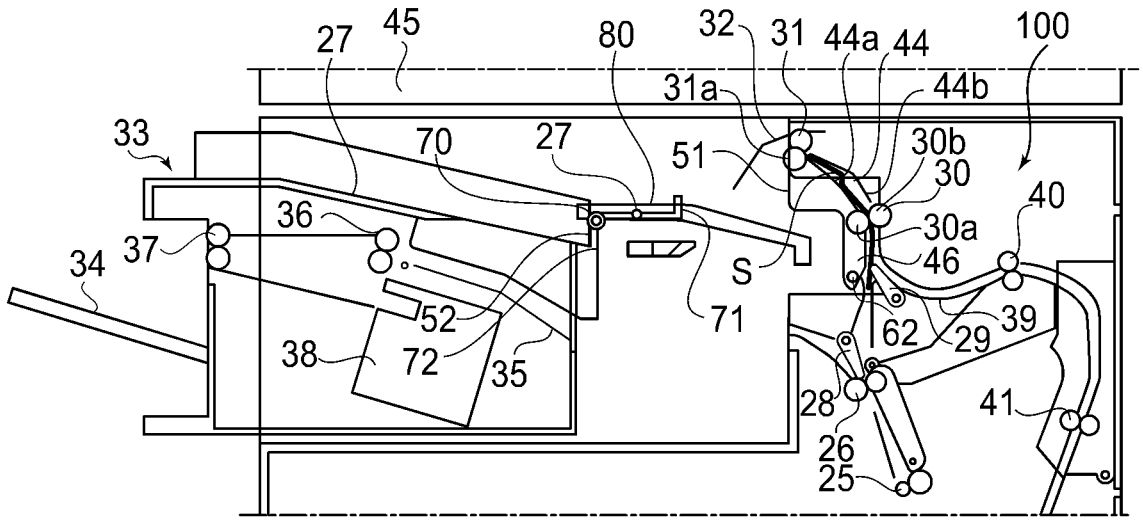
Figure 12:
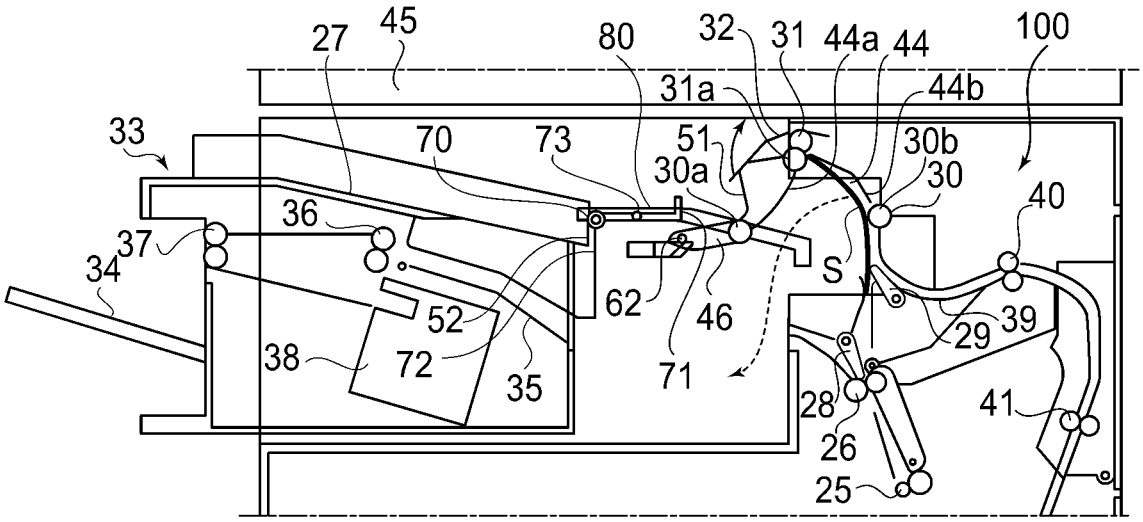

Parts (a) and (b) of FIG. 12 are illustrations of an opening and closing operation of a feeding unit on an apparatus main assembly side in the embodiment 2.

Figure 13:
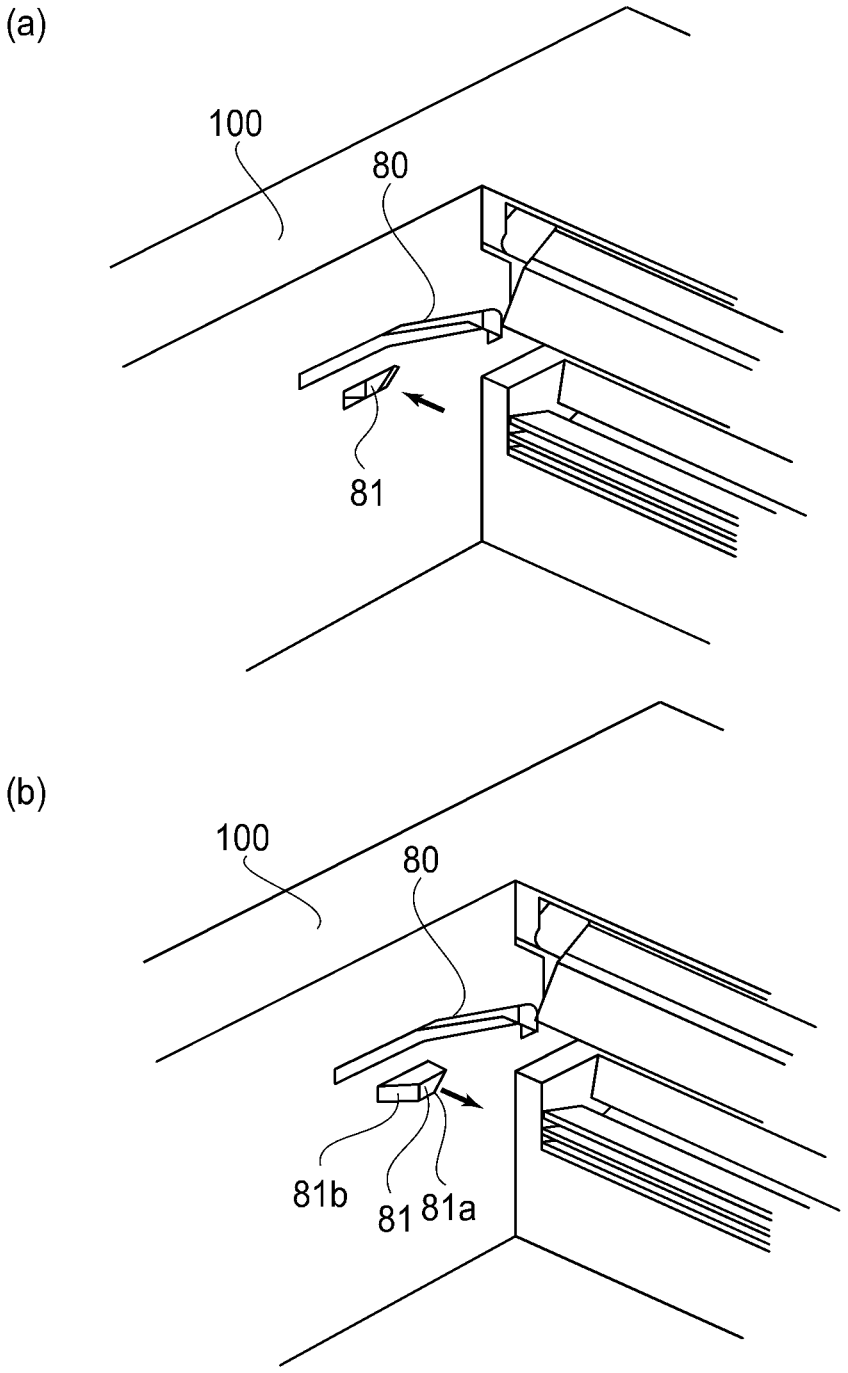

Parts (a) and (b) of FIG. 13 are perspective views of the sheet processing device and the feeding unit in the embodiment 2.

Figure 14:
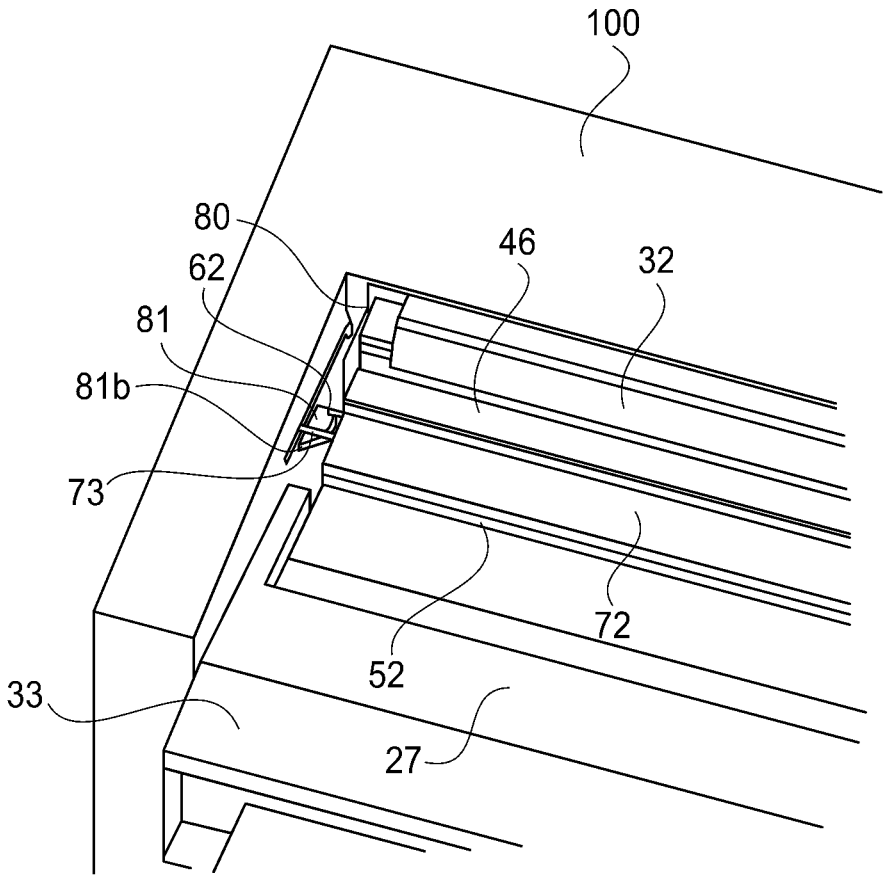

FIG. 14 is a perspective view of the sheet processing device and the feeding unit in the embodiment 2.

Figure 15:
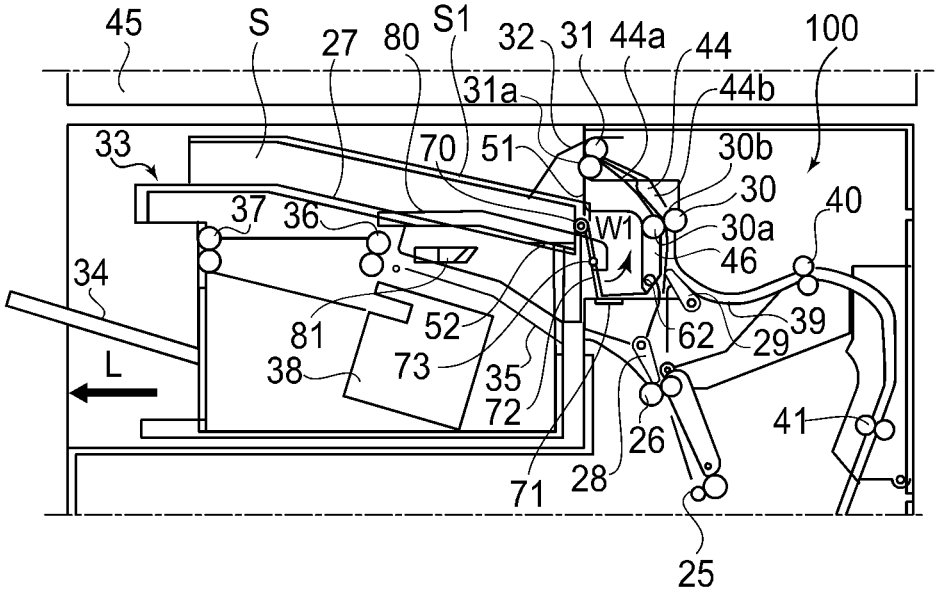

FIG. 15 is an illustration of an opening and closing operation of the sheet processing device and the feeding unit in the embodiment 2.

Figure 16:
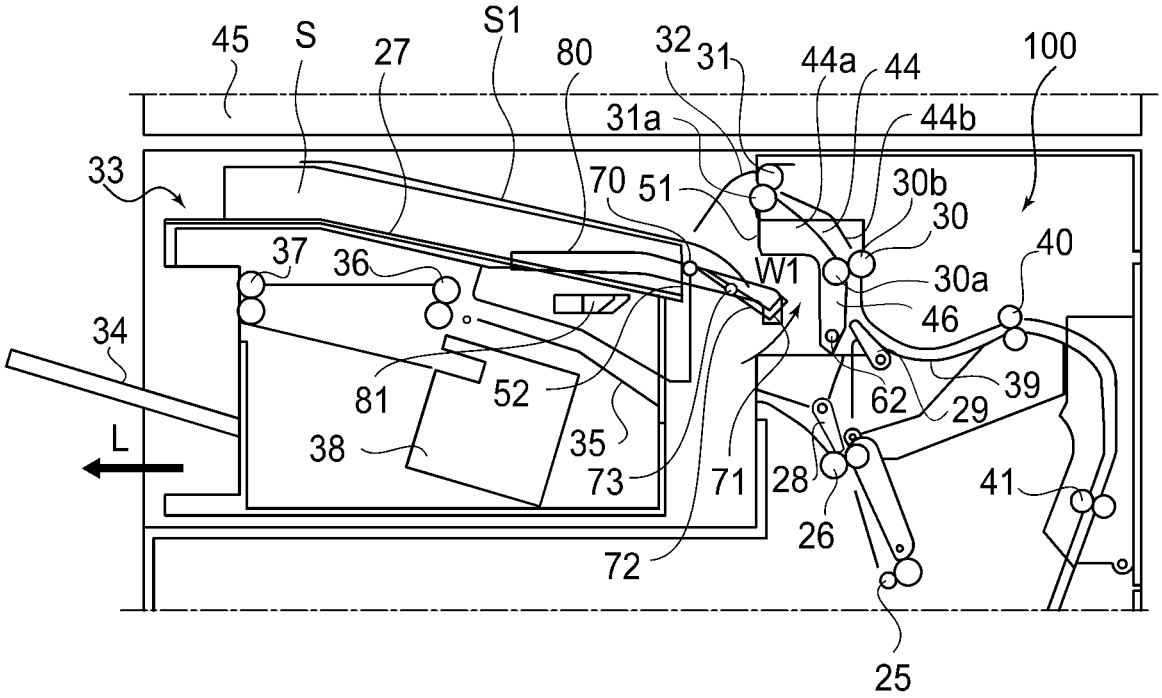

FIG. 16 is an illustration of the opening and closing operation of the sheet processing device and the feeding unit in the embodiment 2.

Figure 17:
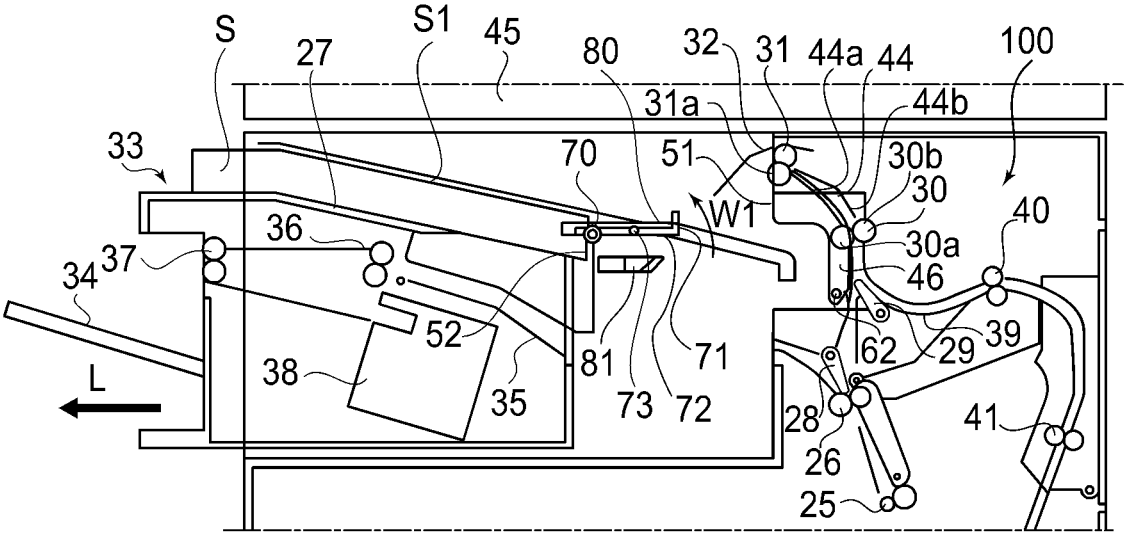

FIG. 17 is an illustration of the opening and closing operation of the sheet processing device and the feeding unit in the embodiment 2.

Figure 18:
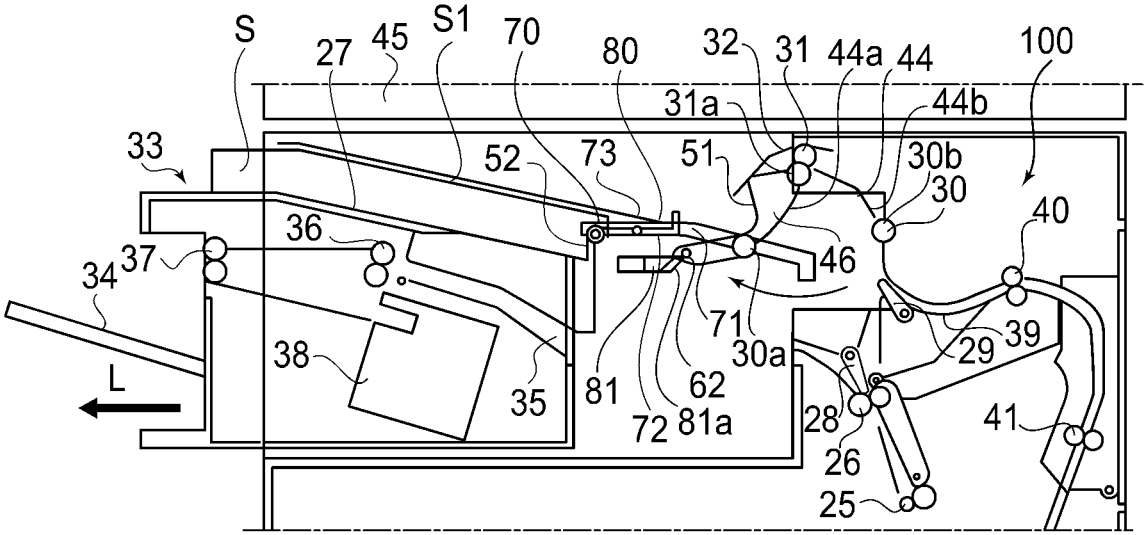

FIG. 18 is an illustration of the open and closing operation of the sheet processing device and the feeding unit in the embodiment 2.

Figure 19:
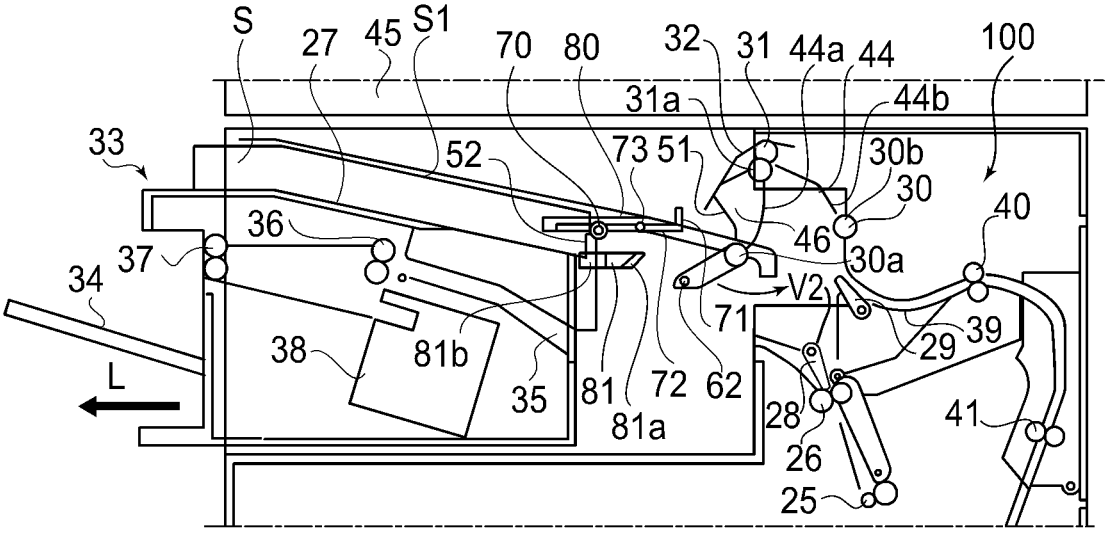

FIG. 19 is an illustration of the open and closing operation of the sheet processing device and the feeding unit in the embodiment 2.

Figure 20:
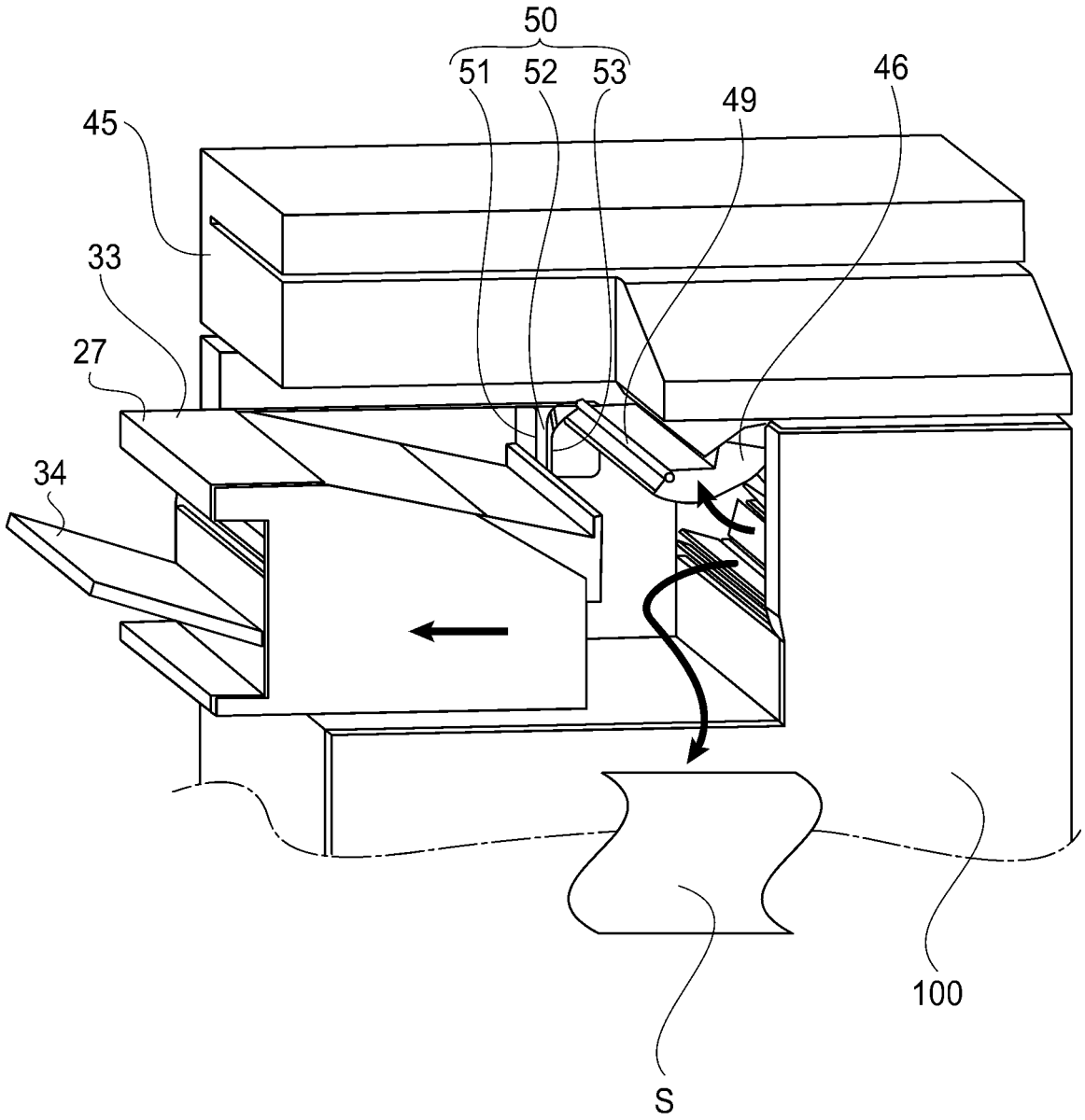

FIG. 20 is an illustration of a jam clearance access position in an embodiment 3.

Figure 21:
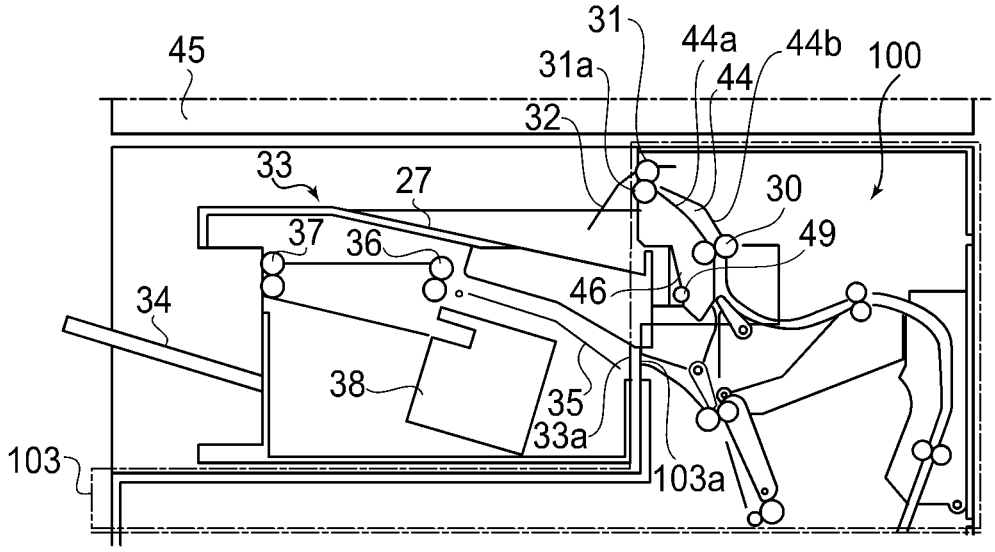
Figure 21:
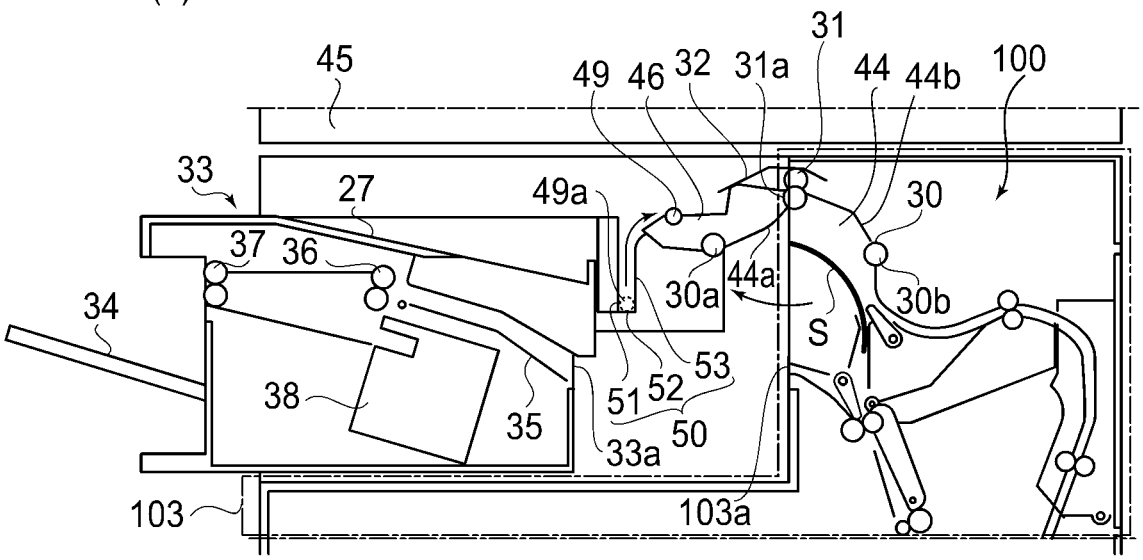

Parts (a) and (b) of FIG. 21 are illustrations of a jam clearance operation by a sliding operation of a sheet feeding device in the embodiment 3.

Figure 22:
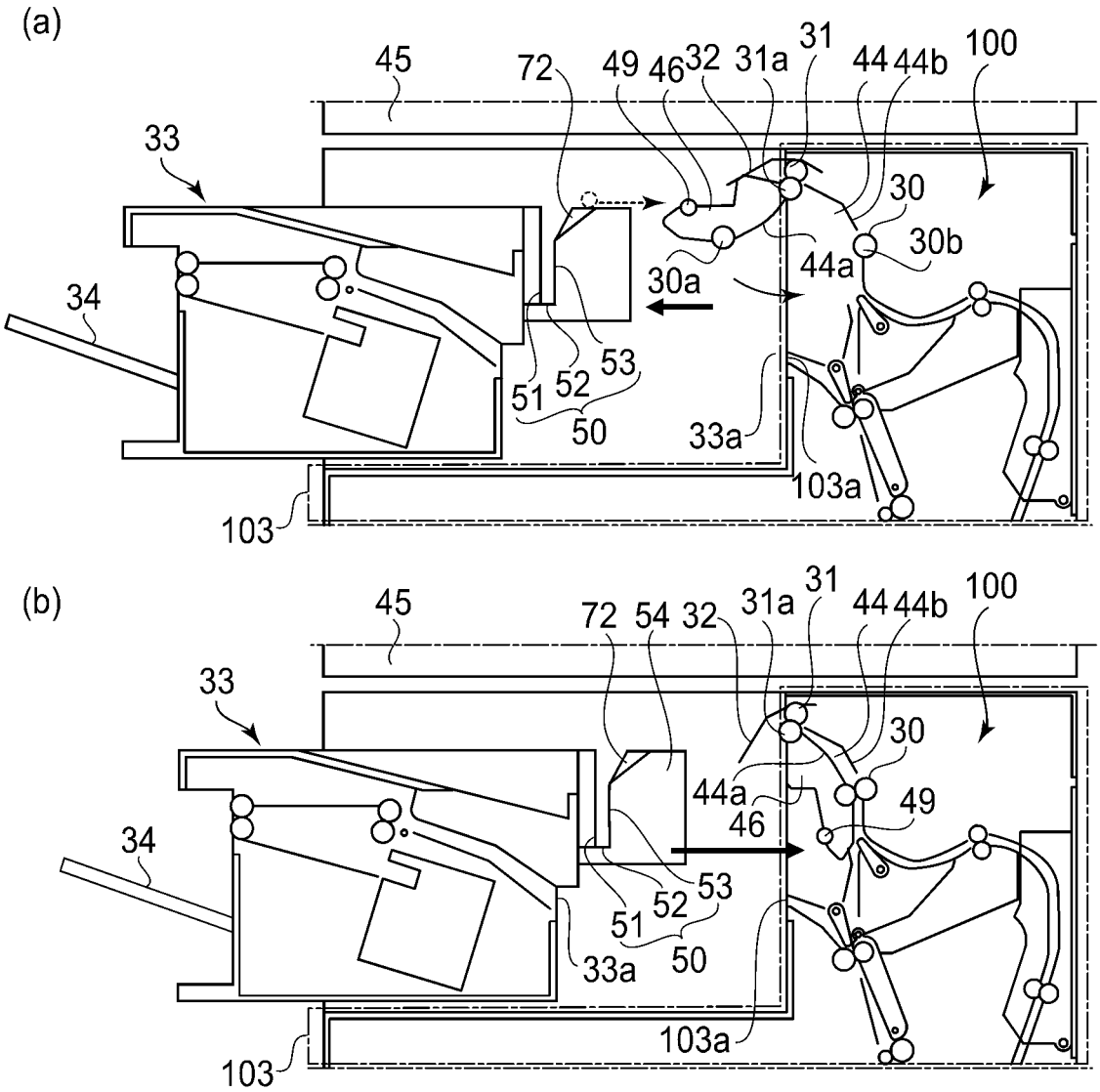

Parts (a) and (b) of FIG. 22 are illustrations of a mounting and dismounting operation of a connecting portion by the sliding operation of the sheet feeding device in the embodiment 3.

Figure 23:
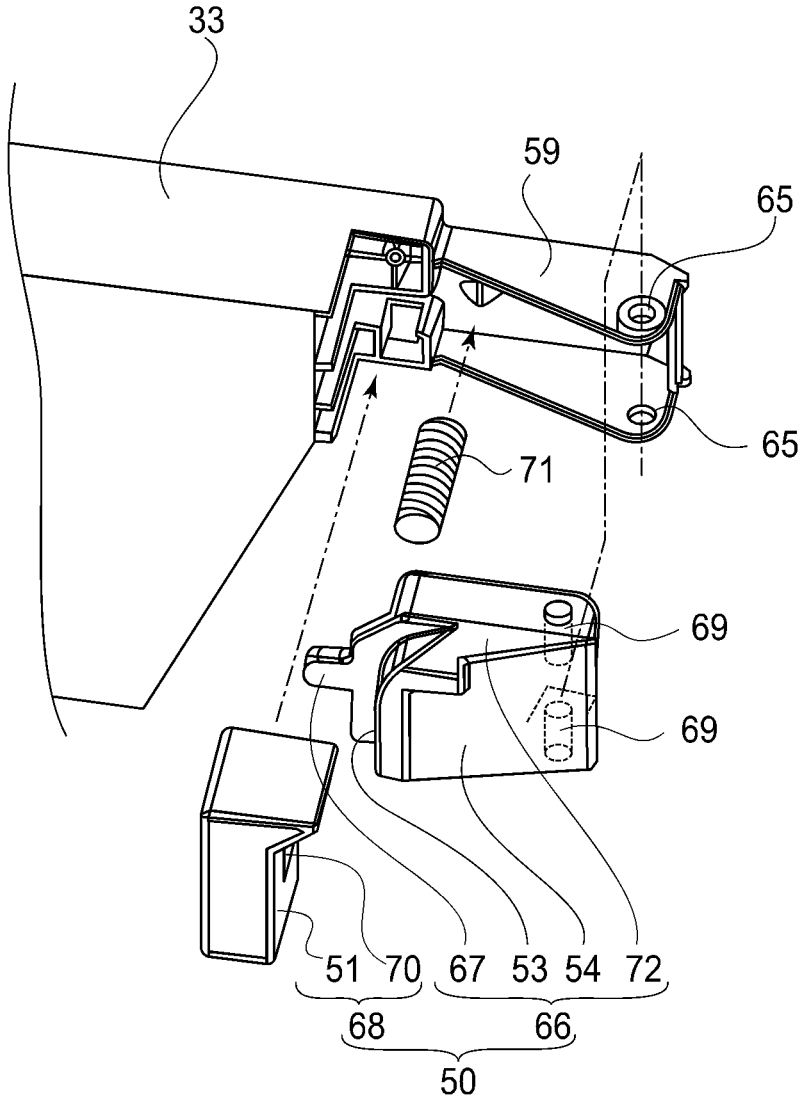

FIG. 23 is a structural illustration of the connecting portion in the embodiment 3.

Figure 24:
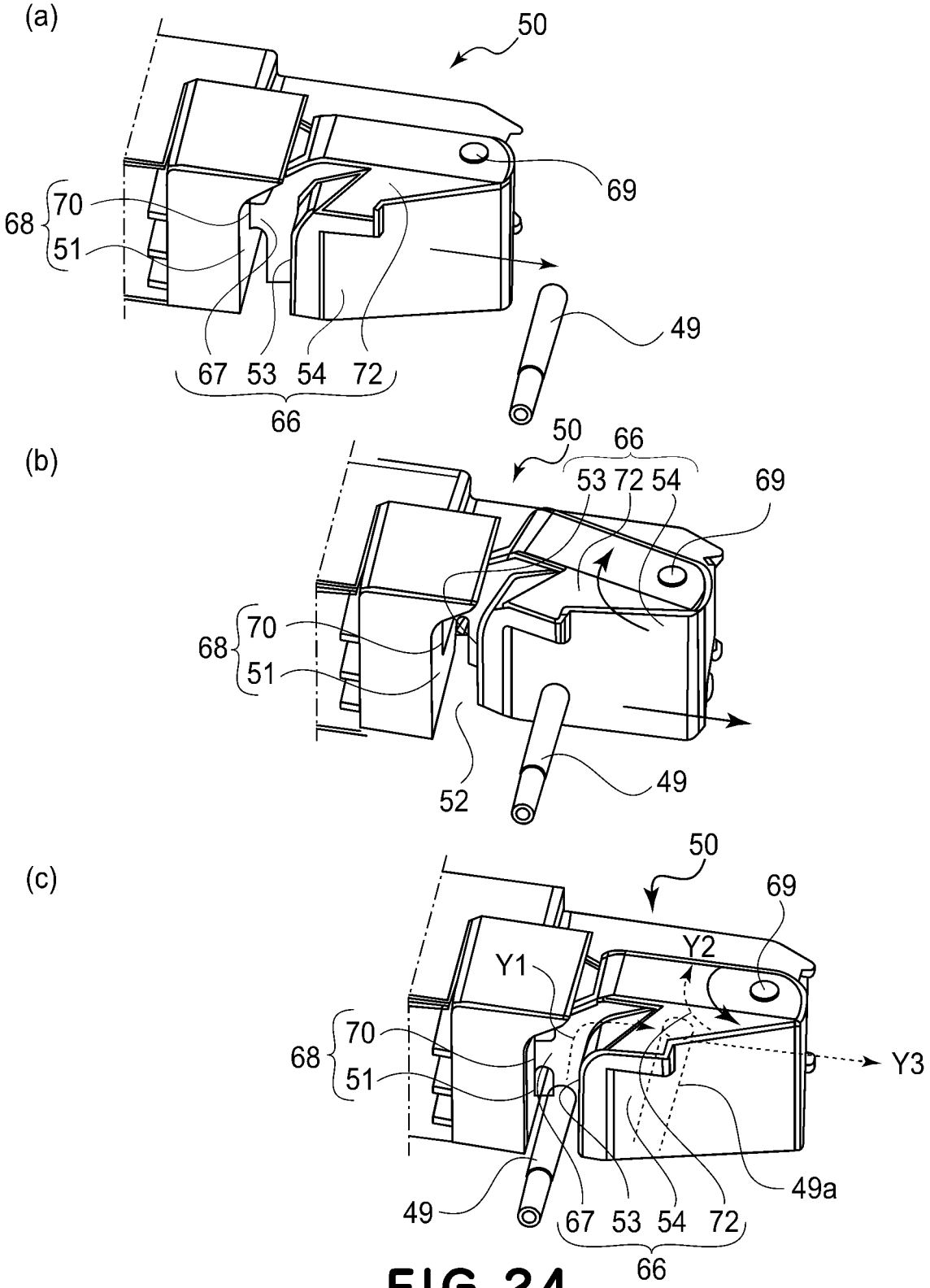

Parts (a), (b) and (c) of FIG. 24 are illustrations of a connecting operation of the connecting portion in the embodiment 3.

Figure 25:
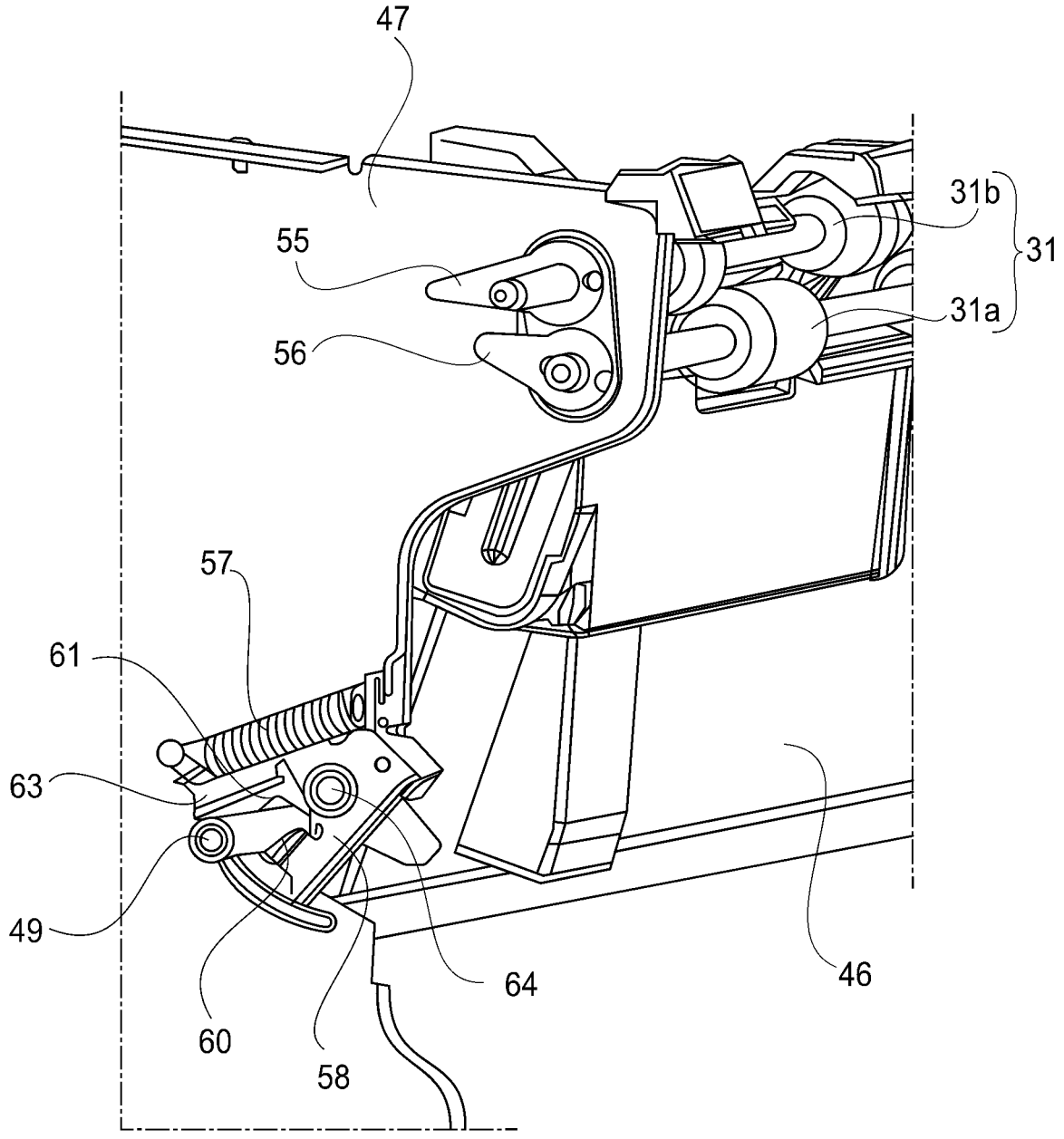

FIG. 25 is an illustration of an operation from holding to release of a guide unit by a toggle mechanism portion in the embodiment 3.

Figure 26:
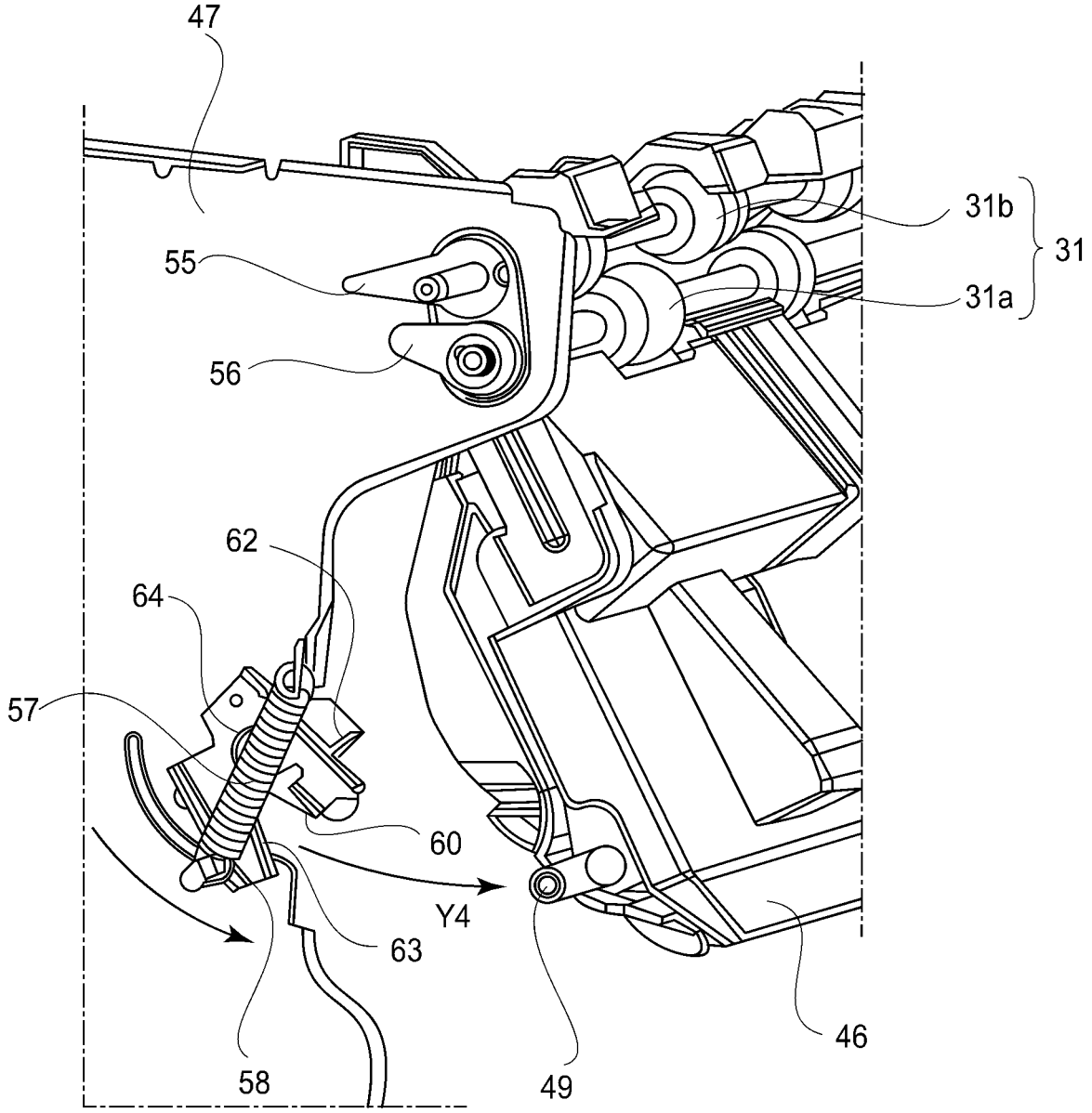

FIG. 26 is an illustration of an operation from the release to the holding of the guide unit by the toggle mechanism portion in the embodiment 3.

Figure 27:
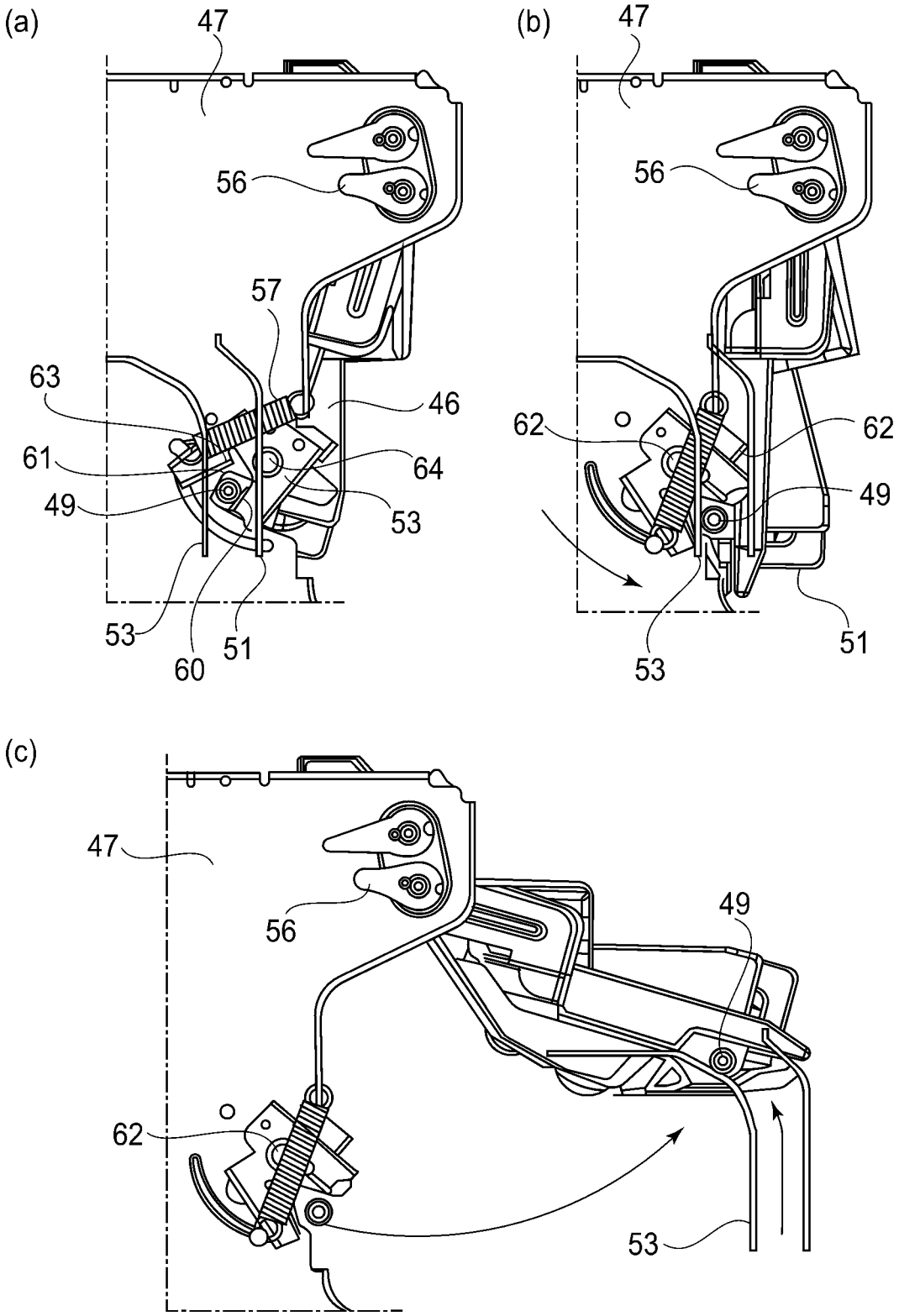

Parts (a), (b) and (c) of FIG. 27 are illustrations of an opening operation of the guide unit on an apparatus main assembly side in the embodiment 3.

Figure 28:
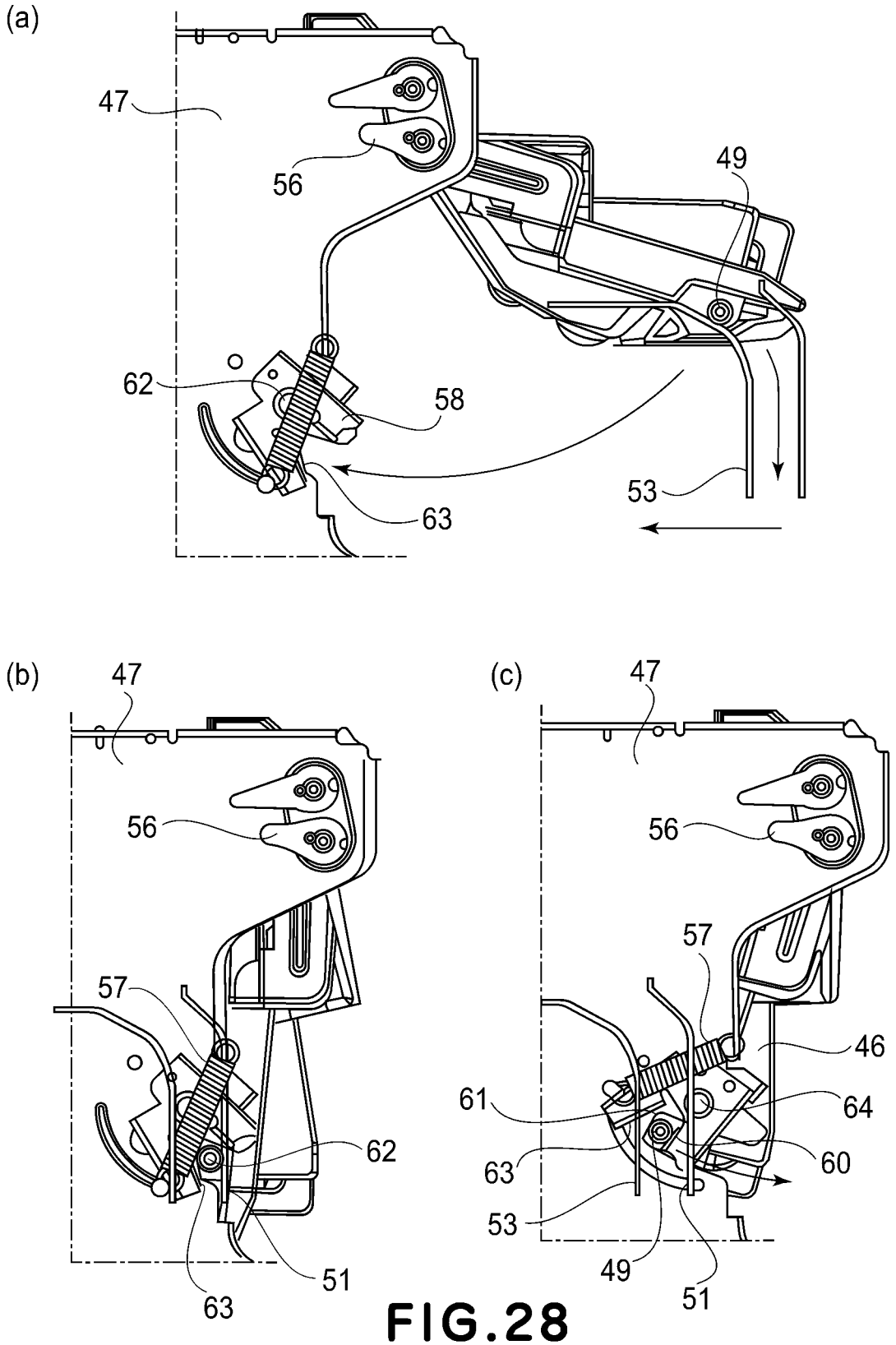

Parts (a), (b) and (c) of FIG. 28 are illustrations of a closing operation of the guide unit on the apparatus main assembly side in the embodiment 3.

DESCRIPTION OF EMBODIMENTS

Embodiments according to the present invention will be specifically described with reference to the drawings. However, dimensions, materials, shapes and relative arrangement of constituent elements described in the following embodiments are not intended such that the scope of the present invention is limited only thereto unless otherwise particularly specified.

Embodiment 1

With reference to FIG. 1 to FIG. 8, an image forming apparatus according to an embodiment 1 will be described. In this embodiment, first, a general structure of the image forming apparatus according to the present invention will be described, and then a structure of a periphery of a discharge tray will be described.

[General Structure of Image Forming Apparatus]

Figure 1:
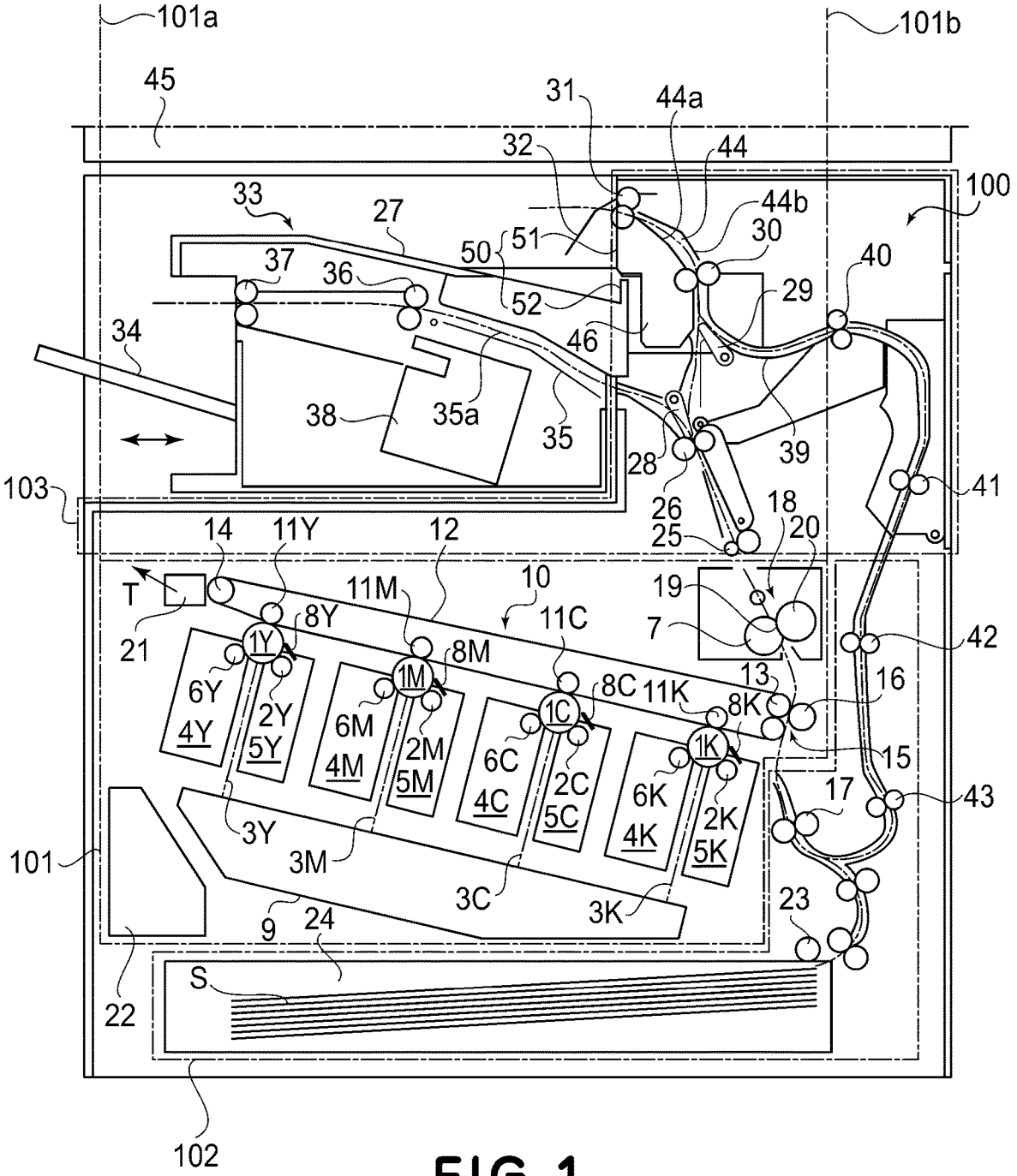
FIG. 1 is a schematic view of an image forming apparatus in an embodiment 1.

FIG. 1 is a sectional view showing a structure of the image forming apparatus according to the embodiment 1. In this embodiment, as an example of the image forming apparatus, a color laser beam printer which has a double-side image forming function and which is of an electrophotographic type is described, but the image forming apparatus is not limited thereto. For example, the image forming apparatus is not limited to only the color laser beam printer, but the present invention may also be applied to other image forming apparatuses such as a copying machine and a facsimile machine.

As shown in FIG. 1, an image forming apparatus 100 includes an image forming portion 101, a sheet feeding portion 102 and a feeding unit 103 which is a feeding portion.

(Image Forming Portion)

The image forming portion 101 forms an image on a sheet and includes process cartridges 3Y, 3M, 3C and 3K, an intermediary transfer belt unit 10, a secondary transfer portion 15 and a fixing device 18 which are described below.

The image forming apparatus 100 shown in FIG. 1 includes the process cartridges 3Y, 3M, 3C and 3K which are mountable and dismountable. These process cartridges 3Y, 3M, 3C and 3K have the same structure but are different in color, i.e., in that images are formed with toners of yellow (Y), magenta (M), cyan (C) and black (K). The process cartridges 3Y, 3M, 3C and 3K are constituted by developing units 4Y, 4M, 4C and 4K and cleaner units 5Y, 5M, 5C and 5K. Of these, the former developing units 4Y, 4M, 4C and 4K include developing rollers 6Y, 6M, 6C and 6K. On the other hand, the latter cleaner units 5Y, 5M, 5C and 5K include photosensitive drums 1Y, 1M, 1C and 1K which are image bearing members, charging rollers 2Y, 2M, 2C and 2K, drum cleaning blades 8Y, 8M, 8C and 8K, and waste (residual) toner container. Vertically below the process cartridges 3Y, 3M, 3C and 3K, an exposure unit 9 is provided, and exposure based on image signals is carried out on the photosensitive drums 1Y, 1M, 1C and 1K. The photosensitive drums 1Y, 1M, 1C and 1K are electrically charged to a predetermined potential, and thereafter, electrostatic latent images are formed, respectively, by the exposure unit 9. These electrostatic latent images are developed with the toners of the developing units 4Y, 4M, 4C and 4K, so that toner images of yellow, magenta, cyan and black are formed.

In the intermediary transfer belt unit 10, an intermediary transfer belt 12 is stretched by a driving roller 13 and tension roller 14. The tension roller 14 applies tension to the intermediary transfer belt 12 in an arrow T direction. The respective photosensitive drums 1Y, 1M, 1C and 1K rotate in the clockwise direction, and the intermediary transfer belt 12 rotates in the counterclockwise direction. Further, to the photosensitive drums 1Y, 1M, 1C and 1K, primary transfer rollers 11Y, 11M, 11C and 11K are provided opposed, respectively, inside the intermediary transfer belt 12, and a transfer bias is applied to the primary transfer rollers by an unshown bias applying means.

By applying the bias to the primary transfer rollers 11Y, 11M, 11C and 11K, the toner images are successively primary transferred from the respective photosensitive drums onto the intermediary transfer belt 12, so that the four color toner images are fed to a secondary transfer portion 15 in a superposed state.

The toners remaining on surfaces of the photosensitive drums 1Y, 1M, 1C and 1K after toner image transfer are removed by cleaning blades 8Y, 8M, 8C and 8K. Further, the toner remaining on the intermediary transfer belt 12 after the secondary transfer onto a sheet S is removed by an intermediary transfer belt cleaning device 21 and is collected by a waste toner collecting container 22.

To the secondary transfer portion 15, the sheet S is fed by a registration roller pair 17 of a sheet feeding portion 102 described later. In the secondary transfer portion 15, by applying a bias to the secondary transfer roller 16, the four color toner images are secondary-transferred from the intermediary transfer belt 12 onto the fed sheet S.

The fixing device 18 which is a fixing portion fixes the toner images of a plurality of colors transferred on the sheet S and includes a heating roller 19 which is a fixing member heated by a heater 7 which is a heating means and includes a pressing roller 20 which is a pressing member rotating while press-contacting the heating roller 19. The sheet S is guided to an entrance guiding portion and is introduced into a fixing nip which is a press-contact portion between the heating roller 19 and the pressing roller 20. The sheet S is nipped and fed in the fixing nip, so that heat and pressure are applied to the sheet S. As a result, the toner images of the plurality of colors are welted and mixed and are fixed as a full-color image on the surface of the sheet S.

The sheet feeding portion 102 feeds the sheet S toward the image forming portion and is constituted by a sheet (paper) feeding cassette 24 which are mountable and dismountable, a sheet feeding belt 23, feeding roller pairs 42 and 43 and the registration roller pair 17.

The sheet feeding roller 23 is rotated by power of an unshown sheet feeding driving unit. The sheet feeding driving unit is fixed to the image forming apparatus 100, and a driving mechanism such as a gear is provided.

By the power of the sheet feeding driving unit, the sheets S are separated and fed one by one from the sheet feeding cassette 24, and the fed sheet S is received by the registration roller pair 17 in a rotation stop state at that time in a manner such that a leading end of the sheet S abuts against a nip of the registration roller pair 17. By this registration roller pair 17, final oblique movement correction of the sheet S, image writing at the image forming portion, and provision of timing of sheet feeding are carried out.

(Feeding Unit)

The sheet S which passed the fixing device 18 and on which the image is formed is fed by a feeding unit 103 which is a feeding portion. The feeding unit 103 includes feeding roller pairs 25 and 26, sort guiding members 28 and 29, a feeding roller pair 30, a discharging roller pair 31, a guide unit 46 which is a movable member including one feeding guide 44*a*, the other feeding guide 44*b*, and feeding roller pairs 40 and 41 for double-side printing.

The sheet S fed from the fixing device 18 is fed by the feeding roller pairs 25 and 26.

In this embodiment, the image forming apparatus 100 includes an image scanner 45, as an image reading portion (image reading device) for reading an image of an original, provided on the feeding unit 103. The image forming apparatus 100 includes a movable sheet processing device 33, which is a stacking portion, between the image forming portion and the image scanner 45 therein. The sheet processing device 33 is disposed immediately above the image forming portion 101. Here, "immediately above the image forming portion" refers to a range from one end portion 101*a* to the other end portion 101*b* of the image forming portion 101. The sheet processing device 33 includes a sheet discharge tray 27 which is a first stacking tray, at an upper surface thereof, and includes a side surface tray 34 which is a second stacking tray, at a side surface thereof.

In the case where the sheet S is discharged onto the sheet discharge tray 27 which is the first stacking tray, the sheet S is guided by the sort guiding members 28 and 29 and passes through the feeding roller pair 30 and is fed to the discharging roller pair 31. The sheet S is fed by the discharging roller pair 31 and is discharged onto the sheet discharge tray 27 at the upper surface of the sheet processing device 33. At this time, the sheet S is discharged on the sheet discharge tray 27 which is the first stacking tray while raising a full stack detecting flag 32.

Further, in the case where the sheet S is discharged onto the side surface tray 34 which is the second stacking tray, the sheet S is guided by the sort guiding member 28 and is fed to the sheet processing device 33. In the sheet processing device 33, the sheet S is guided by a feeding guide 35 forming a sheet feeding passage (second feeding passage) 35*a* and passes through a feeding roller pair 36. The sheet S is then fed to a discharging roller pair 37 and is discharged onto the side surface tray 34 at the side surface of the sheet processing device 33 by the discharging roller pair 37. At this time, the sheet S to be subjected to sheet processing is subjected to the processing by a sheet processing portion 38 in the sheet processing device 33. Thereafter, the sheet S subjected to the processing is fed to the discharging roller pair 37 and then is discharged on the side surface tray 34 which is the second stacking tray at the side surface of the sheet processing device 33.

Further, in the case of an operation in a double-side image formation (double-side printing) mode, feeding of the sheet S is controlled in the following manner. That is, the sheet S which has been subjected to one-side printing is guided by the sort guiding members 28 and 29 and passes through the feeding roller pair 30, and then is fed to the discharging roller pair 31. Rotation of the discharging roller pair 31 is controlled to reverse rotation at timing when a trailing end portion of the sheet S remains between the sort guiding member 29 and the discharging roller pair 31. As a result, the sheet which has been subjected to the one-side printing is fed in a switch-back manner in a direction opposite to a direction in which the sheet S is fed toward the sheet processing device 33. The sheet S fed in the switch-back manner passes through an upper side of the sort guiding member 29 and enters a feeding passage for double-side printing formed by a feeding guide 39, and then is fed successively by a first feeding roller pair 40 for double-side printing and a second feeding roller pair 41 for double-side printing. Thereafter, the sheet S is fed successively by a third feeding roller pair 42 for double-side printing and a fourth feeding roller pair 43 for double-side printing of the sheet feeding portion 102, and then is fed again toward the registration roller pair 17 in a state in which the sheet S is turned upside down.

Then, similarly as in the case of the one-side printing mode, the sheet S is subjected to the oblique movement correction by the registration roller pair 17, the image writing at the image forming portion and the provision of timing of the sheet feeding, and thereafter, the four color toner images are secondary-transferred at the secondary transfer portion 15. Then, the sheet S is introduced into the fixing device 18 again, and then the sheet S which has been subjected to printing on both the first surface and the second surface is discharged onto the sheet discharge tray 27 or the side surface tray 34.

[Sheet Processing Device]

As described above, the sheet processing device 33 which is the stacking portion is provided as an independent unit in the image forming apparatus 100 so as to be slidable (movable) in an arrow direction shown in FIG. 1. In the image forming apparatus 100, the sheet processing device 33 is provided immediately above the image forming portion 101. Here, "immediately above the image forming portion 101" refers to, as described above, the range from the one end portion 101*a* to the other end portion 101*b* of the image forming portion 101. The image scanner 45 which is the image reading portion is provided immediately above the sheet processing device 33 and above the discharging roller pair 31 constituting the feeding unit 103 which is the feeding portion. The sheet processing device 33 is disposed between the image forming portion 101 and the image scanner 45 in the image forming apparatus 100.

The sheet processing device 33 is provided in the image forming apparatus 100 so as to be slidable (movable) in the horizontal direction as shown in parts (a) and (b) of FIG. 3. The sheet processing device 33 includes the sheet discharge tray 27 which is the stacking tray for stacking the sheet discharged from the feeding unit 103 and includes the feeding guide 35 forming the sheet feeding passage along which the sheet fed from the feeding unit 103 is fed. The sheet processing device 33 is a stacking portion constituted so as to be movable between a position shown in part (a) of FIG. 3 which is a first position where the sheet S fed from the feeding unit 103 is capable of being fed to the sheet feeding passage and a position shown in part (b) of FIG. 3 which is a second position being away from the first position. The sheet processing device 33 includes the sheet discharge tray 27 which is the first stacking tray at the upper surface thereof and the side surface tray 34 which is the second stacking tray at the side surface thereof. The sheet processing device 33 includes the feeding guide 35 which is provided below the sheet discharge tray 27 and inside the device and which is a sheet guide for guiding the sheet sent from the feeding unit 103. Further, the sheet processing device 33 includes the feeding roller pair 36 for feeding the sheet guided by the feeding guide 35. Further, the sheet processing device 33 includes the sheet processing portion 38 which is disposed below the feeding guide 35 and which subjects the sheet to the sheet processing. The sheet processing portion 38 is a stapler for subjecting the sheet to binding (processing). The stapler is liable to become large, so that the sheet processing device 33 tends to become high with respect to a vertical direction (height direction) of the image forming apparatus. Further, the sheet processing device 33 includes the discharging roller pair 37 for discharging the processed sheet onto the side surface tray 34.

The feeding unit 103 which is the feeding portion is provided with a discharge opening 103*a* for permitting discharge of the sheet fed by the feeding roller pair 26 and guided by the sort guiding member 28. The sheet processing device 33 which is the stacking portion is provided with a feeding (supplying) opening 33*a*, for receiving the sheet discharged through the discharge opening 103*a*, at a position opposing the discharge opening 103*a* of the feeding unit 103. Further, when the sheet processing device 33 is in the position shown in part (a) of FIG. 3 which is the first position where the sheet S fed from the feeding unit 103 through the discharge opening 103*a* is capable of being fed to the feeding opening 33*a* of the sheet processing device 33, a distance from the discharge opening 103*a* to the feeding opening 33*a* is shortest. On the other hand, when the sheet processing device 33 is in the position shown in part (b) of FIG. 3 which is the second position being away from the first position, compared with the case of the first position, the distance from the discharge opening 103*a* to the feeding opening 33*a* is long.

[Periphery of Sheet Discharge Tray]

At a periphery of the sheet discharge tray 27, there are provided the discharging roller pair 31 for discharging the sheet on the sheet discharge tray 27 and the full stack detecting flag 32 for detecting passing of the sheet through the discharging roller pair 31 and a height of the sheet(s) stacked on the sheet discharge tray 27. Below the discharging roller pair 31, there is provided a stacking wall 50 which is a supporting wall for supporting a trailing end of the sheet stacked on the sheet discharge tray 27, which is an upstream-side end portion of the sheet with respect to a sheet feeding direction. The stacking wall 50 in this embodiment is constituted by a part 51 of the image forming apparatus 100 and a part 52 of the sheet processing device 33. A sheet stacking surface of the sheet discharge tray 27 forms an inclined surface ascending from the stacking wall 50 toward a downstream side with respect to a sheet discharging direction so that a preceding sheet discharged early is not pushed out by the sheet currently discharged through the discharging roller pair 31.

The discharging roller pair 31 feeds the sheet, and therefore, a relative position thereof with an upstream feeding passage 44 (first feeding passage) with respect to the sheet feeding direction becomes important. The feeding passage 44 is a sheet feeding passage formed by one feeding guide 44*a* which is a feeding guide for guiding the sheet and the other feeding guide 44*b* opposing the feeding guide 44*a*. By supporting the discharging roller pair 31 by the image forming apparatus 100 including a driving source (not shown) to the feeding roller pair 30, it is possible to efficiently input drive (driving force) to the discharging roller pair 31 in a small number of component parts. For that reason, the discharging roller pair 31 is provided in the image forming apparatus 100.

The full stack detecting flag 32 detects passing of the sheet through the nip of the discharging roller pair 31 and thus has a function as a feeding sensor for notifying an unshown controller of the image forming apparatus 100 of stagnation and delay of the sheet. Further, the full stack detecting flag 32 detects the passing of the sheet through the nip of the discharging roller pair 31 and thus has a function as a full state detecting sensor for preventing overloading (excessive stack) by detecting a height of the sheet(s) stacked on the sheet discharge tray 27. As regards the full stack detecting flag 32, a relative relationship between itself and the discharging roller pair 31 is important, and therefore, the full stack detecting flag 32 is supported rotatable relative to the image forming apparatus 100 including the discharging roller pair 31.

The stacking wall 50 supports the trailing end of the sheet stacked on the sheet discharge tray 27 at the upper surface of the sheet processing device 33 and extends from the sheet stacking surface of the sheet discharge tray 27 to immediately below the discharging roller pair 31.

When the trailing end of the sheet discharged through the discharging roller pair 31 is caught by the stacking wall 50, a position of the sheet descending on the sheet discharge tray 27 is disordered, so that an alignment property of the stacked sheet(s) becomes worse. Further, the trailing end of the sheet leans on the stacking wall 50, so that although only sheets in a small number are stacked, the full stack detecting flag 32 recognizes that sheets in a predetermined amount are stacked and then a printing operation is stopped in some instances. For this reason, a positional relationship between a lower roller of the discharging roller pair 31 and the stacking wall 50 with respect to the sheet feeding direction is an important item (factor).

When a gap (spacing) between the stacking wall 50 and the lower roller 31*a* of the discharging roller pair 31 with respect to an up-down direction is excessively large, there is a possibility that when the sheets are stacked on the sheet discharge tray 27 to a full state, an uppermost sheet of the stacked sheets contacts the lower roller and is pulled into an apparatus main assembly of the image forming apparatus. When the gap between the stacking wall 50 and the lower roller 31*a* of the discharging roller pair 31 with respect to the up-down direction is excessively small, noise is generated by contact therebetween. For this reason, a positional relationship between the lower roller 31*a* of the discharging roller pair 31 and the stacking wall 50 with respect to the up down-direction also becomes important.

The sheet processing device 33 including the sheet discharge tray 27 is configured to be slidable (movable) in the sheet discharging direction in a jam clearance operation described later. Further, as described above, the discharging roller pair 31 and the full stack detecting flag 32 are provided to the image forming apparatus 100 in view of a relationship thereof with the feeding passage 44. For this reason, the stacking wall 50 of which positional relationship with the discharging roller pair 31 is important is divided into upper and lower portions with respect to the vertical (up-down) direction. That is, the stacking wall 50 comprises an upper stacking wall 51 which is a first supporting wall provided on an upper side with respect to the vertical direction and a lower stacking wall 52 which is a second supporting wall provided on a lower side with respect to the vertical direction.

The upper stacking wall 51 of which positional relationship with the discharging roller pair 31 is important is provided to the guide unit 46 including one feeding guide 44*a* forming the feeding passage 44 to the discharging roller pair 31. The guide unit 46 provided with the upper stacking wall 51 is provided rotatable relative to the image forming apparatus 100. On the other hand, the lower stacking wall 52 on a side lower than the upper stacking wall 51 with respect to the vertical direction is provided on the sheet processing device 33. Specifically, the lower stacking wall 52 is provided at a rear end portion which is an upstream-side end portion of the sheet discharge tray 27 with respect to the sheet feeding direction. The lower stacking wall 52 is provided on the sheet discharge tray 27 of the sheet processing device 33, so that even when the sheet processing device 33 is slid in a state in which sheets to some extent are stacked on the sheet discharge tray 27, a stacking state of the sheets is not disordered.

A divided position of the upper stacking wall 51 and the lower stacking wall 52 of the stacking wall 50 is lower than a free end of the full stack detecting flag 32 with respect to the vertical direction. Specifically, an upper end of the lower stacking wall 52 is lower than the free end of the full stack detecting flag 32 with respect to the vertical direction. As a result, even when the sheet processing device 33 is slid, the sheet processing device 33 can be moved with no interference between the full stack detecting flag 32 and the lower stacking wall 52.

Further, a positional relationship among the lower roller 31*a* of the discharging roller pair 31, the upper stacking wall 51 and the lower stacking wall 52 of the stacking wall 50 with respect to the sheet feeding direction is as shown in FIG. 9. That is, with respect to the sheet feeding direction (an arrow direction shown in FIG. 9), a sheet end portion restricting surface of the upper stacking wall 51 is positioned on a side upstream of an outer peripheral surface of the lower roller 31*a* of the discharging roller pair 31. Further, a sheet end portion restricting surface of the lower stacking wall 52 is positioned on a side upstream of the restricting surface of the upper stacking wall 51. As a result, worsening of the alignment property of the sheets stacked on the sheet discharge tray 27 due to catch of the trailing end of the sheet, discharged through the discharging roller pair 31, by the stacking wall 50 can be prevented.

Further, a positional relationship between the lower roller 31*a* of the discharging roller pair 31 and the upper stacking wall 51 of the stacking wall 50 with respect to the up-down direction is as shown in FIG. 9. The lower roller 31*a* of the discharging roller pair 31 is divided and disposed with respect to a widthwise direction perpendicular to the sheet feeding direction. Further, the upper stacking wall 51 of the stacking wall 50 includes a projection 51*a* projecting between the divided lower roller portions of the discharging roller pair 31 with respect to the widthwise direction of the sheet. As a result, even when there is a gap between the upper stacking wall 51 of the stacking wall 50 and the outer peripheral surface of the lower roller 31*a* of the discharging roller pair 31 with respect to the up-down direction, the uppermost sheet of the sheets stacked on the sheet discharge tray 27 can be prevented from being pulled into the apparatus main assembly of the image forming apparatus by contact thereof with the lower roller 31*a*.

[Interrelation Between Sheet Processing Device and Feeding Unit]

Next, interrelation between the sheet processing device 33 and the guide unit 46 which is a movable member when the sheet S is jammed in the feeding passage 44 for permitting sheet discharge onto the sheet discharge tray 27 will be described.

In this embodiment, the guide unit 46 which is the movable member interrelates with movement of the sheet processing device 33. A state in which only the sheet processing device 33 is slid (moved) is shown in parts (a) and (b) of FIG. 2, and a state in which the guide unit 46 is moved in interrelation with the slide (movement) of the sheet processing device 33 is shown in parts (a) and (b) of FIG. 3.

The guide unit 46 constitutes the feeding unit 103 which is the feeding portion for feeding the sheet on which the image is formed, and includes one feeding guide 44*a* of the guide forming the feeding passage 44 to the discharging roller pair 31 and one roller 30*a* of the feeding roller pair 30. The guide unit 46 is the movable member provided rotatable relative to the image forming apparatus 100 about a rotation shaft, as a rotation sheet processing device, of the lower roller 31*a* of the discharging roller pair 31. Accordingly, the feeding passage 44 can be opened by rotating the guide unit 46 about the rotation shaft of the lower roller 31*a* in a direction in which the guide unit 46 is moved away from the other feeding guide 44*b* opposing the feeding guide 44*a* and the other roller 30*b* of the shaft roller pair 30. The rotation shaft of the lower roller 30*a* which is the rotation supporting point of the guide unit 46 is provided above the upstream-side end portion of the sheet discharge tray 27 with respect to the sheet feeding direction. Herein, the upstream-side end portion of the sheet discharge tray 27 with respect to the sheet feeding direction is an upper end portion of the lower stacking wall 52 described later. The guide unit 46 includes an engaging pin 62 engaged with the sheet processing device 33 including the sheet discharge tray 27. The engaging pin 62 is provided on an end portion side opposite from the rotation shaft side of the guide unit 46 and is positioned below the upstream-side end portion of the sheet discharge tray 27 with respect to the sheet feeding direction at an operation position of the sheet processing device 33.

Further, the sheet processing device 33 which is the stacking portion is connected with the image forming apparatus main assembly via an unshown rail unit between the image forming portion 101 and the image scanner 45 in the image forming apparatus 100. Here, the image forming apparatus main assembly refers to a portion excluding, of constituent elements of the image forming apparatus 100, the sheet processing device 33, the image scanner 45, the process cartridges and the sheet feeding unit which constitute the image forming apparatus 100. The sheet processing device 33 is configured so as to be slidable (movable) relative to the image forming apparatus main assembly along rails. The sheet processing device 33 is movable between the position shown in part (a) of FIG. 3 which is the first position where the sheet S fed from the feeding unit 103 is capable of being fed to the sheet feeding passage and the position shown in part (b) of FIG. 3 which is the second position being away from the first position.

The sheet processing device 33 which is the stacking portion is provided with an arm portion 61, which is a connecting member having a cam groove 60 which is a guiding portion, on an outside of a sheet feeding region with respect to the widthwise direction perpendicular to the sheet feeding direction. The cam groove 60 engages with the engaging pin 62 and guides the engaging pin side of the guide unit 46 so as to move about the rotation shaft from below toward above with movement of the sheet processing device 33 from the first position to the second position. The engaging pin 62 of the guide unit 46 and the cam groove 60 of the sheet processing device 33 are provided on the outside of the sheet feeding region and on a rear side of the apparatus main assembly with respect to the widthwise direction perpendicular to the sheet feeding direction as shown in FIG. 4. FIG. 4 is a perspective view, of a principal part, showing a state excluding the image scanner 45 and a state in which the sheet processing device 33 is slid and in which the guide unit 46 is rotated. Accordingly, engagement between the engaging pin 62 and the cam groove 60 is made on the outside of the sheet feeding region, and therefore, does not prevent feeding of the sheet. Further, the engagement between the engaging pin 62 and the cam groove 60 is made on the rear side opposite from a front side of the apparatus main assembly which is an operation side during jam clearance, and therefore, does not prevent an operation of the jam clearance. Here, the front side of the apparatus main assembly is one side with respect to the widthwise direction perpendicular to the sheet feeding direction, and the rear side of the apparatus main assembly is the other side opposite from the one side with respect to the widthwise direction perpendicular to the sheet feeding direction.

In the case where the sheet jammed in the neighborhood of the feeding passage 44 which is a periphery of a connecting portion between the feeding opening 33*a* of the sheet processing device 33 and the discharge opening 103*a* of the feeding unit 103 is removed, the sheet processing device 33 is moved in the following manner. That is, the sheet processing device 33 is slid (moved) from an operation position which is the first position shown in part (a) of FIG. 3 to a jam clearance position which is the second position shown in part (b) of FIG. 3. Then, the cam groove 60 means together with the sheet processing device 33 and contacts the engaging pin 62 of the guide unit 46, and thus rotates the guide unit 46 about the rotation shaft of the lower roller 31*a* of the discharging roller pair 31. That is, in interrelation with the movement of the sheet processing device 33 from the operation position to the jam clearance position, the guide unit 46 is rotated from the position shown in part (a) of FIG. 3 to the position shown in part (b) of FIG. 3. Specifically, the guide unit 46 including one feeding guide 44*a* and one roller 30*a* is rotated about the rotation shaft of the lower roller 31*a* in a direction in which the guide unit 46 is moved away from the other feeding guide 44*b* and the other roller 30*b* which oppose the one feeding guide 44*a* and the one roller 30*a*, respectively. As a result, as shown in part (b) of FIG. 3, a jam clearance space is formed between the sheet processing device 33 and the feeding unit 103, so that the feeding passage 44 formed by the feeding guides 44*a* and 44*b* is opened. Accordingly, the feeding passage 44 on the feeding unit side is opened only by moving the sheet processing device 33 to the jam clearance position, so that the sheet jammed in the neighborhood of the feeding passage 44 can be easily removed.

Next, a process in which the sheet processing device 33 is slid (moved) from the operation position to the jam clearance position in a state in which the sheets are stacked on the sheet discharge tray 27 so as to be over the lower stacking wall 52 will be described using FIG. 5 to FIG. 8.

As shown in FIG. 5, the sheets are in a state of being stacked, on the sheet discharge tray 27 of the sheet processing device 33 being in the operation position, over the lower stacking wall 52. When the sheet processing device 33 is slid in an arrow direction from this operation position shown in FIG. 5 toward the jam clearance position, the sheets stacked on the sheet discharge tray 27 so as to be over the lower stacking wall 52 are positionally deviated by impact (shock) of a start of movement of the sheet processing device 33 in some instances. The sheet discharge tray 27 has the sheet stacking surface which is a downwardly-sloping inclination in FIG. 5, and therefore, the stacked sheets are liable to move toward the guide unit 46 side. Further, as regards the sheets stacked over the lower stacking wall 52, the free end of the full stack detecting flag 32 contacts an uppermost sheet S1 of the stacked sheets as shown in FIG. 5. For this reason, on the uppermost sheet S1, friction thereof with the full stack detecting flag 32 acts, and therefore the uppermost sheet S1 is liable to be positionally deviated particularly toward the guide unit 46 side.

As shown in FIG. 6, the sheet processing device 33 is moved from the operation position toward the jam clearance position in an arrow L direction. Then, the cam groove 60 provided on the arm portion 61 of the sheet processing device 33 contacts the engaging pin 62 of the guide unit 46 and causes the sheet processing device 33 to start rotation about the lower roller 31*a* of the discharging roller pair 31 as the rotation shaft in an arrow V1 direction which is the clockwise direction. At this time, the uppermost sheet S1 stacked over the lower stacking wall 52 of the sheet discharge tray 27 moves toward the guide unit 46 in a broken line arrow direction for the above-described reason in some instances. Even in such a case, the engaging pin side of the guide unit 46 positioned below the upper end of the lower stacking wall 52 rotates from below toward above about the rotation shaft of the lower roller 31*a* developed above the upper end of the lower stacking wall 52. That is, the engaging pin side of the guide unit 46 moves from below toward above so as to close an upper portion of a space formed between itself and the feeding unit 103 by the movement of the sheet processing device 33. For this reason, the sheet S1 moving toward the guide unit 46 contacts the guide unit 46 and stops.

Further, by movement of the sheet processing device 33 toward the jam clearance position, the sheets stacked on the sheet discharge tray 27 so as to be over the lower stacking wall 52 move toward the guide unit 46 in some instances. Even in such a case, as described above, the engaging pin side of the guide unit 46 positioned below the upper end of the lower stacking wall 52 moves from below toward above about the rotation shaft of the lower roller 31*a* developed above the upper end of the lower stacking wall 52. That is, the engaging pin side of the guide unit 46 rotates from below toward above so as to close an upper portion of a space formed between itself and the feeding unit 103 by the movement of the sheet processing device 33. For this reason, the sheets stacked on the sheet discharge tray 27 so as to be over the lower stacking wall 52 also contact the guide unit 46 and stop similarly as the uppermost sheet S1.

As shown in FIG. 7, even when the sheet processing device 33 moves to the neighborhood of an intermediary position between the operation position and the jam clearance position, the guide unit 46 continues movement so as to cover an upper portion of a space from which the sheet processing device 33 is retracted, by contact between the engaging pin 62 and the cam groove 60. For this reason, even when the uppermost sheet S1 drops in the space, the sheet S1 can be scooped up by the guide unit 46 moving in the space from below toward above. Further, the sheets stacked on the sheet discharge tray 27 so as to be over the lower stacking wall 52 can also be scooped up by the guide unit 46 moving in the space from below toward above similarly as in the case of the uppermost sheet S1. Then, when the sheet processing device 33 moves to the jam clearance position shown in FIG. 8, the engaging pin 62 of the guide unit 46 contacts an upper portion of the cam groove 60, so that the guide unit 46 moves to a substantially horizontal position and covers the upper portion of the space formed by retraction of the sheet processing device 33.

Thus, according to this embodiment, the guide unit 46 as the movable member moving in interrelation with the movement of the sheet processing device 33 moves so as to close the upper portion of the space formed by the movement of the sheet processing device 33. As a result, the sheets stacked on the sheet discharge tray 27 so as to be over the lower stacking wall 52 are, even when the sheets move toward the space, scooped up by the guide unit 46 moving, toward the space, from below toward above the lower stacking wall 52. For this reason, even in the case where the sheet processing device 33 is moved in a state in which the sheets are stacked on the sheet discharge tray 27, the sheets stacked on the sheet discharge tray 27 can be prevented from dropping in the jam clearance space formed by the retraction of the sheet processing device 33. For this reason, when the sheet jammed in the feeding passage 44 on the inside of the feeding unit 103 is removed, the sheet processing device 33 including the sheet discharge tray 27 on which the sheets are still fully stacked can be moved, so that operativity of the jam clearance can be improved.

Embodiment 2

In the above-described embodiment, a constitution in which the guide unit 46 as the movable member is provided in the feeding unit 103 of the image forming apparatus 100 was described as an example, but in this embodiment, a constitution in which a movable wall as a movable member is provided on a sheet processing device will be described as an example. The constitution in which the movable wall as the movable member is provided on the sheet processing device will be described using FIG. 10 to FIG. 19.

In this embodiment, as shown in FIG. 10, movable wall 72 as the movable member is rotatably provided to the sheet discharge tray 27. The movable wall 72 as the movable member is provided so that one end portion thereof is rotatable about a shaft 70 at an upper end of the lower stacking wall 52 which is the upstream-side end portion of the sheet discharge tray 27 with respect to the sheet feeding direction. Further, the movable wall 72 is provided at the other end portion thereof with a bent portion 71 against which the rear end of the sheet processing device 33 which is the upstream-side end portion of the sheet processing device 33 with respect to the sheet feeding direction. When the sheet processing device 33 is in the operation position which is the first position shown in FIG. 10, the movable wall 72 opposes the guide unit 46 forming the feeding passage 44 of the feeding unit 103 and is held by a back surface of the lower stacking wall 52.

The movable wall 72 includes an engaging pin 73 engaged with the image forming apparatus 100. The image forming apparatus 100 includes a cam groove 80 which is a guiding portion engaging with the engaging pin 73 of the movable wall 72.

The cam groove 80 guides the engaging pin 73 so that the bent portion side of the movable wall 72 moves about the shaft 70, which is a rotation center, from below toward above with movement of the sheet processing device 33 from the operation position being the first position to a retracted position being a second position.

When the sheet processing device 33 is moved from the operation position being the first position to the retracted position (jam clearance position) being the second position, the engaging pin 73 of the movable wall 72 opens the cam groove 80 and is guided along the cam groove 80, so that the movable wall 72 is rotated so as to raise the bent portion 71 from below to above. That is, the movable wall 72 is moved, in interrelation with the movement of the sheet processing device 33 from the operation position to the jam clearance position which is the retracted position, about the shaft 70 which is the rotation center of one end portion from below toward above the lower stacking wall 52 on the bent portion side.

As shown in FIG. 14, the engaging pin 73 of the movable wall 72 and the cam groove 80 which is the guiding portion of the image forming apparatus 100 are provided on the outside of the sheet feeding region and on a rear side of the apparatus main assembly with respect to the widthwise direction perpendicular to the sheet feeding direction. As shown in FIG. 14, the engaging pin 73 projected on one side (the rear side of the apparatus main assembly) with respect to the widthwise direction of the movable wall 72 is provided, and the cam groove 80 is formed on an opposing surface of the image forming apparatus 100 opposing the engaging pin 73 with respect to the widthwise direction. FIG. 14 is a perspective view, of a principal part, showing a state excluding the image scanner 45 and a state in which the sheet processing device 33 is slid and in which the movable wall 72 and the guide unit 46 are rotated. Accordingly, engagement between the engaging pin 73 and the cam groove 80 is made on the outside of the sheet feeding region, and therefore, does not prevent feeding of the sheet. Further, the engagement between the engaging pin 73 and the cam groove 80 is made on the rear side opposite from a front side of the apparatus main assembly which is an operation side during jam clearance, and therefore, does not prevent an operation of the jam clearance. Here, the front side of the apparatus main assembly is one side with respect to the widthwise direction perpendicular to the sheet feeding direction, and the rear side of the apparatus main assembly is the other side opposite from the one side with respect to the widthwise direction perpendicular to the sheet feeding direction.

The guide unit 46 constitutes, similarly as in the above-described embodiment, the feeding unit 103 which is the feeding portion for feeding the sheet on which the image is formed, and includes one feeding guide 44*a* of the guide forming the feeding passage 44 to the discharging roller pair 31 and one roller 30*a* of the feeding roller pair 30. The guide unit 46 is the movable member provided rotatable relative to the image forming apparatus 100 about a rotation shaft, as a rotation sheet processing device, of the lower roller 31*a* of the discharging roller pair 31. Accordingly, the feeding passage 44 can be opened by rotating the guide unit 46 about the rotation shaft of the lower roller 31*a* in a direction in which the guide unit 46 is moved away from the other feeding guide 44*b* opposing the feeding guide 44*a* and the other roller 30*b* of the shaft roller pair 30. The rotation shaft of the lower roller 30*a* which is the rotation supporting point of the guide unit 46 is provided above the upstream-side end portion of the sheet discharge tray 27 with respect to the sheet feeding direction. Herein, the upstream-side end portion of the sheet discharge tray 27 with respect to the sheet feeding direction is an upper end portion of the lower stacking wall 52 described later. The guide unit 46 includes the engaging pin 73 projected on one side (the rear side of the apparatus main assembly) with respect to the widthwise direction perpendicular to the sheet feeding direction. The engaging pin 73 is engaged with the sheet processing device 33 including the sheet discharge tray 27. The engaging pin 73 is provided on an end portion side opposite from the rotation shaft side of the guide unit 46.

Further, as shown in parts (a) and (b) of FIG. 13, below the cam groove 80 of the image forming apparatus 100, a latch 81 which is slidable in the widthwise direction perpendicular to the sheet feeding direction and which is urged by an unshown spring from the image forming apparatus side to the sheet processing device side which is the stacking portion side is provided. The latch 81 is pressed by a side surface of the sheet processing device 33 when the sheet processing device 33 is in the operation position, and thus is in a retracted position where the latch 81 is retracted against an elastic force of the spring as shown in part (a) of FIG. 13. On the other hand, when the sheet processing device 33 moves to the neighborhood of the jam clearance position and does not overlap with the latch 81, the latch 81 slides to a projected position by the elastic force of the spring as shown in part (b) of FIG. 13. The latch 81 is movable between a position shown in part (b) of FIG. 12 and a position shown in part (a) of FIG. 12. The position shown in part (b) of FIG. 12 is a holding position for holding the one feeding guide 44*a*, of the feeding guides forming the feeding passage 44, at an open position where the feeding guide 44*a* is moved away from the other feeding guide 44*b* and thus the feeding passage 44 is opened. The position shown in part (a) of FIG. 12 is a position including a release position where holding of the one feeding guide 44*a* held at the open position is released.

As shown in part (b) of FIG. 13, the latch 81 is provided with a first inclined surface 81*a* and a second inclined surface 81*b*. The first inclined surface 81*a* is an inclined surface capable of moving the engaging pin 73 in the widthwise direction against the urging force in contact with the engaging pin 73 when the guide unit 46 including the one feeding guide 44*a* is rotated from the position shown in part (a) of FIG. 12 to the position shown in part (b) of FIG. 12. The latch 81 holds the guide unit 46 passed through the first inclined surface 81*a* at the open position shown in part (a) of FIG. 12. The second inclined surface 81*b* is an inclined surface capable of moving the side surface of the sheet processing device 33 in the widthwise direction against the urging force in contact with the side surface of the sheet processing device 33 when the sheet processing device 33 is moved from the retracted position being the second position toward the operation position being the first position. The latch 81 is moved in the widthwise direction against the urging force by contact thereof with the sheet processing device 33 and thus releases the holding of the guide unit 46.

In the case where the sheet jammed in the neighborhood of the feeding passage 44 which is a periphery of a connecting portion between the feeding opening 33*a* of the sheet processing device 33 and the discharge opening 103*a* of the feeding unit 103 is removed, the sheet processing device 33 is moved in the following manner. That is, the sheet processing device 33 is slid (moved) from the operation position which is the first position shown in FIG. 10 to the jam clearance position which is the second position shown in FIG. 11. After the sheet processing device 33 is moved to the jam clearance position shown in part (a) of FIG. 12, when the guide unit 46 is rotated as shown in part (b) of FIG. 12, the feeding passage 44 is opened, so that it becomes possible to access the jammed sheet S. When the guide unit 46 is rotated, the engaging pin 62 on the free end side opens the first inclined surface 81*a* of the latch 81. Then, the latch 81 is slid against the elastic force of the spring by the first inclined surface 81*a* and is retracted to the position shown in part (a) of FIG. 13, and therefore, the guide unit 46 is capable of being continuously rotated. Then, when the engaging pin 62 passes through the latch 81, the elastic force of the spring is released, so that the latch 81 is slid and projected to the position shown in part (b) of FIG. 13. Thus, the latch 81 projects under the engaging pin 62, so that as shown in part (b) of FIG. 12 and FIG. 14, the guide unit 46 can be held by the latch 81 at the position where the feeding passage 44 is opened. As a result, the sheet S jammed in the neighborhood of the feeding passage 44 can be easily removed as shown by an arrow indicated by a broken line.

Next, a process in which the sheet processing device 33 is slid (moved) from the operation position to the jam clearance position in a state in which the sheets are stacked on the sheet discharge tray 27 so as to be over the lower stacking wall 52 and thus the guide unit 46 is opened will be described using FIG. 15 to FIG. 18.

FIG. 15 shows a state in which the sheet processing device 33 is started to be moved toward the jam clearance position. As shown in FIG. 15, the sheet processing device 33 is started to be moved in an arrow L direction from the operation position toward the jam clearance position. Then, the cam groove 80 and the engaging pin 73 of the movable wall 72 contact each other, so that the movable wall 72 is started to be rotated about the shaft 70 in an arrow W1 direction in FIG. 15. At this time, the uppermost sheet S1 of the sheets stacked on the sheet discharge tray 27 moves toward the guide unit 46 side by inclination of the sheet discharge tray 27, impact of a start of movement of the sheet processing device 33 and contact thereof with the full stack detecting flag 32 in some instances. In this embodiment, the guide unit 46 including the upper stacking wall 51 is not interrelated with the movement of the sheet processing device 33, so that in a state of the start of the movement of the sheet processing device 33, the uppermost sheet S1 stops in a state of contacting the upper stacking wall 51.

When the sheet processing device 33 is moved to a position shown in FIG. 16, the movable wall 72 is raised from below to above by contact between the cam groove 80 and the engaging pin 73, so that the movable wall 72 is rotated in the arrow W1 direction so as to close an upper portion of a space from which the sheet processing device 33 is retracted. At this time, the free end of the full stack detecting flag 32 is positioned above corners of a batch of the sheets stacked on the sheet discharge tray 27 so as to be over the lower stacking wall 52, and therefore, the uppermost sheet S1 starts to flex downwardly at the leading end thereof by a weight of the full stack detecting flag 32. However, at this time the leading end of the sheet S1 can be scooped up by the bent portion 71 which is a lower end portion of the movable wall 72.

When the sheet processing device 33 is further retracted from this side in the arrow L direction, as shown in FIG. 17, the movable wall 72 is in a substantially horizontal attitude. At this time, since the leading end of the sheet S1 was able to be scooped up by the bent portion 71, the sheets stacked on the sheet discharge tray 27 do not drop in the space formed by retraction of the sheet processing device 33. Further, even when the sheets stacked on the sheet discharge tray 27 so as to be over the lower stacking wall 52 move toward the guide unit 46, similarly, the movable wall 72 is capable of scooping up the sheets stacked over the lower stacking wall 52. For this reason, the stacked sheets do not drop in the space formed by the retraction of the sheet processing device 33.

When the sheet processing device 33 moves to the jam clearance position and does not overlap with the latch 81, as described above, the latch 81 slides and projects into the space formed by the movement of the sheet processing device 33. Thereafter, when the guide unit 46 is rotated, as described above, the engaging pin 62 of the guide unit 46 and the first inclined surface 81*a* of the latch 81 contact each other, so that the latch 81 is slid and retracted and thus permits rotation of the guide unit 46. When the guide unit 46 is further continuously rotated, the engaging pin 62 of the guide unit 46 passes through the latch 81 and is in a state shown in FIG. 18. Then, the latch 81 projects again in the space by the electric force of the spring, and therefore, as shown in FIG. 18, the guide unit 46 is held at a spaced position where the feeding passage 44 is opened.

For this reason, even when the sheet processing device 33 is moved to the jam clearance position in a state in which the sheets are stacked on the sheet discharge tray 27 of the sheet processing device 33 until a stacking state thereof is close to a full state, the stacked sheets are prevented from dropping in the space formed by the movement of the sheet processing device 33. Further, the sheet jammed in the feeding passage 44 can be easily removed.

Next, the case where the sheet processing device 33 is moved to the operation position after the sheet jammed in the feeding passage 44 is removed will be described using FIG. 19. As shown in FIG. 19, the sheet processing device 33 is moved from the jam clearance position toward the operation position in an arrow R direction. Then, by contact between the second inclined surface 81*b* of the latch 81 and the sheet processing device 33, the latch 81 is slid against the elastic force of the spring and is retracted to the position shown in part (a) of FIG. 13. Then, holding of the engaging pin 62 of the guide unit 46 by the latch 81 is also released, so that the guide unit 46 rotates in an arrow V2 direction shown in FIG. 19 by a self-weight thereof. By further moving the sheet processing device 33 toward the operation position, the guide unit 46 is moved to the position where the guide unit 46 forms the feeding passage 44, while moving the movable wall 72 downwardly, so that the sheet processing device can be restored to the position shown in FIG. 10.

As described above, according to this embodiment, the movable wall 72 as the movable member moving in interrelation with the movement of the sheet processing device 33 moves so as to close the upper portion of the space formed by the movement of the sheet processing device 33. As a result, the sheets fully stacked on the sheet discharge tray 27 of the sheet processing device 33 can be prevented from dropping in the jam clearance space formed by the movement of the sheet processing device 33. For this reason, when the sheet jammed in the feeding passage 44 on the inside of the feeding unit 103 is removed, the sheet processing device 33 including the sheet discharge tray 27 on which the sheets are still fully stacked can be moved, so that operativity of the jam clearance can be improved.

Embodiment 3

Next, with reference to FIG. 20 to FIG. 28, a constitution of an embodiment 3 in which a connecting member 50 mountable to and dismountable from the feeding unit 103 in the image forming apparatus 100 is provided to the slidable (movable) sheet processing device 33 will be described.

[Sheet Removing Method]

First, a sheet removing method when the sheet S is jammed in the neighborhood of a connecting portion between the feeding opening 33*a* of the sheet processing device 33 and the discharge opening 103*a* of the feeding unit 103 in this embodiment will be described. In this embodiment, the sheet removing method when the sheet S is jammed in the neighborhood of the first feeding passage 44 for permitting discharge of the sheet S to the sheet discharge tray 27 will be described.

In this embodiment, the guide unit 46 (movable member) interrelates with movement of the sheet processing device 33. FIG. 20 is a perspective view of the image forming apparatus which is in a state that the guide unit 46 forming the first feeding passage 44 is opened for removing the sheet S from the first feeding passage 44 in the feeding unit 103 and which is seen from an obliquely left front side. Parts (a) and (b) of 21 are sectional views of a principal part showing a state in which the guide unit 46 is moved in interrelation with the movement of the sheet processing device 33 from the operation position which is the first position to the retracted position which is the second position.

The guide unit 46 includes one feeding guide 44*a* of the guide forming the first feeding passage 44 for guiding the sheet on which the image is formed and includes one roller 30*a* of the feeding roller pair 30. The guide unit 46 is the movable member provided rotatable relative to the image forming apparatus 100 about a rotation shaft, as a rotation sheet processing device, of the lower roller 31*a* of the discharging roller pair 31. Accordingly, the first feeding passage 44 can be opened as shown in FIG. 20 by rotating the guide unit 46 about the rotation shaft of the lower roller 31*a* in a direction in which the guide unit 46 is moved away from the other feeding guide 44*b* opposing the feeding guide 44*a* and the other roller 30*b* of the shaft roller pair 30. The guide unit 46 includes a link stack 49 which is an engaging portion engageable with the sheet processing device 33 including the sheet discharge tray 27 so as to mountable to and dismountable from the sheet processing device 33. The link shaft 49 is provided on an end portion side opposite from the rotation shaft side of the guide unit 46. The link shaft 49 extends in the widthwise direction perpendicular to the sheet feeding direction of the guide unit 46 and projects on one side of the guide unit 46 with respect to the widthwise direction.

The sheet processing device 33 which is the stacking portion is connected with the image forming apparatus main assembly via an unshown rail unit between the image forming portion 101 and the image scanner 45 in the image forming apparatus 100. Here, the image forming apparatus main assembly refers to a portion excluding, of constituent elements of the image forming apparatus 100, the sheet processing device 33, the image scanner 45, the process cartridges and the sheet feeding unit which constitute the image forming apparatus 100. The sheet processing device 33 is configured so as to be slidable (movable) relative to the image forming apparatus main assembly along rails. The sheet processing device 33 is movable between the position shown in part (a) of FIG. 21 which is the first position where the sheet S fed from the feeding unit 103 is capable of being fed to the sheet feeding passage and the position shown in part (b) of FIG. 21 which is the second position being away from the first position.

The sheet processing device 33 includes the connecting member 50 which is a connecting portion connected to the guide unit 46 so as to be mountable to and dismountable from the guide unit 46. The connecting member 50 which is the connecting portion includes a swingable member 66 which is a movable portion and a fixing member 68 which is a fixing portion as shown in FIG. 23. The swingable member 66 which is the movable portion is provided movable relative to a supporting member 59 of the sheet processing device 33 in the widthwise direction perpendicular to the sheet feeding direction. The fixing member 68 which is the fixing portion is provided opposed to the swingable member 66 with respect to a movement direction of the sheet processing device 33 and is fixed to the supporting member 59. The connecting member 50 is provided with a groove portion 52 formed by a moving wall 53 of the swingable member 66 and a fixing wall 51 of the fixing member 68. The connecting member 50 slides (moves) the sheet processing device 33 from the upstream position which is the first position to the retracted position which is the second position, and thus acts on the link shaft 49 of the guide unit 46, so that the connecting member 50 is capable of opening the guide unit 46 as shown in FIG. 20. This connecting member 50 will be specifically described later.

With reference to parts (a) and (b) of FIG. 21, jam clearance when the sheet processing device 33 is moved from the operation position (first position) to the retracted position (second position) will be described. Incidentally, the retracted position (second position) is also the jam clearance position, and therefore, is also referred to as the jam clearance position in the following.

Part (a) of FIG. 21 shows a state in which the sheet processing device 33 is connected to the feeding unit 103, and shows a state in which the sheet processing device 33 is in the first position where the sheet S fed through the discharge opening 33*a* of thereof is capable of being fed to the sheet processing device 33 through the feeding opening 33*a*. From this state, the sheet processing device 33 is slid (moved) from the operation position (first position) shown in part (a) of FIG. 21 to the jam clearance position (second position) shown in part (b) of FIG. 21 when the sheet S jammed in the neighborhood of the first feeding passage 44 in the image forming apparatus is removed. In part (b) of FIG. 21, when the sheet processing device 33 is in the position shown in part (b) of FIG. 21 which is the second position being away from the first position, compared with the case of the first position, a distance from the discharge opening 103*a* to the feeding opening 33*a* is long. Part (b) of FIG. 21 shows a state in which the sheet processing device 33 is slid (moved) to the jam clearance position (second position) being away from the feeding unit 103. The link shaft 49 of the guide unit 46 positioned in the groove portion 52 of the connecting member 50 provided to the sheet processing device 33 in part (a) of FIG. 21 is moved from a position 49*a* indicated by a broken line to a position 49 indicated by a solid line in part (b) of FIG. 21. By movement of the sheet processing device 33 from the operation position to the jam clearance position, the moving wall 53 of the connecting member 50 acts on the link shaft 49 of the guide unit 46, so that the guide unit 46 is swung about a rotation shaft, as a supporting point, of the lower roller 31*a* of the discharging roller pair 31. For this reason, the guide unit 46 is swung in an arrow direction of part (b) of FIG. 21 so as to be away from the other feeding guide 44*b* and is held by the connecting member 50 in the jam clearance position where the first feeding passage 44 is opened as shown in part (b) of FIG. 21. By the operation described above, it becomes possible to access the inside of the first feeding passage 44, so that the sheet S jammed in the neighborhood of the first feeding passage 44 can be removed.

Part (a) of FIG. 22 shows a state in which the sheet processing device 33 is slid (moved) from the jam clearance position of part (b) of FIG. 21 in a direction of being further away from the discharging roller pair 31. As shown in part (a) of FIG. 22, when the sheet processing device 33 is moved from the jam clearance position of part (b) of FIG. 21 in the direction of being further away from the discharging roller pair 31, the link shaft 49 of the guide unit 46 is moved away from the connecting member 50 and thus the connection of the connecting member 50 is released. Thus, the sheet processing device 33 is capable of releasing a connecting state thereof with the guide unit 46 of the image forming apparatus only by the sliding operation thereof.

Part (b) of FIG. 22 shows a state in which the guide unit 46 disconnected from the connecting member 50 is swung in the counterclockwise direction by a self-weight thereof and closes the first feeding passage 44. From this state, the sheet processing device 33 is slid (moved) toward the operation position, so that the link shaft 49 of the guide unit 46 engages with (contacts) an inclined surface 54 of the connecting member 50. Thereafter, with further movement of the sheet processing device 33, the moving wall 53 of the connecting member 50 is moved from one side to the other side with respect to the widthwise direction perpendicular to the sheet feeding direction by the link shaft 49 engaged with the inclined surface 54 of the connecting member 50. Thereafter, by moving the sheet processing device 33 until the engagement of the link shaft 49 with the inclined surface 54 is released, the link shaft 49 is moved to the groove portion 52 of the connecting member 50, so that the connecting member 50 is connected to the guide unit 46 again.

[Operation of Connecting Member During Mounting and Dismounting of Sheet Processing Device]

With reference to FIGS. 23 and 24, a structure of the connecting member 50, and motion during connection and separation (disconnection) between the connecting member 50 and the link shaft 49 will be described below.

As described above, the connecting member 50 which is the connecting portion includes the swingable member 66 which is the movable portion and the fixing member 68 which is the fixing portion as shown in FIG. 23. The swingable member 66 which is the movable portion is provided movable to the supporting member 59 and is constituted by the moving wall 53, the inclined surface 54, a holding surface 72, an abutting portion 67 and a supporting shaft 69. The fixing member 68 which is the fixing portion is fixed to the supporting member 59 and is constituted by the fixing wall 51 and a receiving portion 70.

The swingable member 66 is held swingable relative to the supporting member 59 in the widthwise direction perpendicular to the sheet feeding direction by inserting the supporting shaft 69 into holes 65 of the supporting member 59. Further, the swingable member 66 receives a force from one side toward the other side with respect to the widthwise direction perpendicular to the sheet feeding direction by a spring 71. That is, the swingable member 66 receives the force in a direction in which the swingable member 66 is moved away from the supporting member 59 by the spring 71. The swingable member 66 urged by the spring 71 is prevented from opening during swinging by abutment of the abutting portion 67 of the swingable member 66 against the receiving portion 70 of the fixing member 68 including the fixing wall 51 having a wall surface opposing the moving wall 53.

The moving wall 53 of the swingable member 66 has a surface crossing the movement direction of the sheet processing device 33. The surface of the moving wall 53 is a first acting surface actable on the link shaft 49 so that the guide unit 46 is rotated in a direction of being moved away from the other feeding guide 44*b* opposing the one feeding guide 44*a* with an operation of moving the sheet processing device 33 from the operation position to the jam clearance position. The holding surface 72 of the swingable member 66 is a surface following the movement direction of the sheet processing device 33. The holding surface 72 holds the link shaft 49 with respect to a direction of gravitation so that the guide unit 46 is held in a state in which the first feeding passage 44 formed by the feeding guides 44*a* and 44*b* is opened. This holding surface 72 holds the link shaft 49 so that the sheet processing device 33 is movable in the direction of being further away from the jam clearance position. The holding surface 72 is inclined downwardly from one side toward the other side with respect to the widthwise direction perpendicular to the sheet feeding direction.

The inclined surface 54 of the swingable member 66 is provided below the holding surface 72 on a side downstream of the moving wall 53 having the first acting surface with respect to the movement direction of the sheet processing device 33 from the retracted position to the operation position. The inclined surface 54 is inclined downwardly toward a downstream surface with respect to the movement direction of the sheet processing device 33 from the retracted position to the operation position.

The fixing wall 51 of the fixing member 68 has a surface crossing the movement direction of the sheet processing device 33. The fixing wall 51 is provided opposed to the moving wall 53 having the first acting surface of the swingable member 66 with respect to the movement direction of the sheet processing device 33. The surface of the fixing wall 51 is a second acting surface actable on the link shaft 49 so that the guide unit 46 is rotated in a direction of being moved toward the other feeding guide 44*b* opposing the one feeding guide 44*a* with an operation of moving the sheet processing device 33 from the retracted position to the operation position.

Parts (a), (b) and (c) of FIG. 24 are partially perspective views for illustrating an operation of the connecting member 50 during mounting and dismounting of the sheet processing device 33. Part (a) of FIG. 24 shows a state in which connection between the connecting member 50 of the sheet processing device 33 and the link shaft 49 of the guide unit 46 on the feeding unit side is released. By moving the sheet processing device 33 toward the operation position, the connecting member 50 of the sheet processing device 33 is moved from a position shown in part (a) of FIG. 24 to a position shown in part (b) of FIG. 24. With this mounting of the sheet processing device 33, the inclined surface 54 of the connecting member 50 contacts (engages with) the link shaft 49 of the guide unit 46 on the feeding unit side. Thereafter, with further movement of the sheet processing device 33, the swingable member 66 of the connecting member 50 is swung about the supporting shaft 69 clockwise by the link shaft 49 engaged with the inclined surface 54 from one side toward the other side with respect to the widthwise direction perpendicular to the sheet feeding direction.

By further moving the sheet processing device 33 toward the operation position, the connecting member 50 of the sheet processing device 33 is moved from the position shown in part (b) of FIG. 24 to a position shown in part (c) of FIG. 24. With this movement of the sheet processing device 33, the engagement of the link shaft 49 with the inclined surface 54 is released, so that the link shaft 49 enters the groove portion 52. At this time, the swingable member 66 disengaged from the link shaft 49 is swung about the supporting shaft 69 counterclockwise from the other side toward the one side with respect to the widthwise direction by the force of the spring 71 shown in FIG. 23. The abutting portion 67 of the swingable member 66 abuts against the receiving portion 70 of the fixing member 68, so that the moving wall 53 of the swingable member 66 projects to an actable position on the link shaft 49. As a result, on the link shaft 49, the moving wall 53 is actable from the one side with respect to the movement direction of the sheet processing device 33 and the fixing wall 51 is actable from the other side, so that the connecting member 50 is in the state of being connected with the guide unit 46 again.

That is, relative to the disconnected guide unit 46, the swingable member 66 of the connecting member 50 swings correspondingly to an amount of the movement of the sheet processing device 33, so that the connecting member 50 is capable of being connected with the link shaft 49 again.

From the connected state between the connecting member 50 and the link shaft 49 shown in part (c) of FIG. 24, the sheet processing device 33 is slid (moved) toward the retracted position retracted from the operation position. Then, with movement of the sheet processing device 33, the link shaft 49 abuts against the moving wall 53 of the connecting member 50, so that the guide unit 46 is swung in a direction of being moved away from the other feeding guide 44*b* opposing the one feeding guide 44*a*. Thereafter, by the swing operation of the guide unit 46, the link shaft 49 is raised in an upward direction as shown by an arrow Y1 indicated by a broken line along the moving wall 53 and reaches the holding surface 72. The link shaft having reached the holding surface 72 is a link shaft 49*a* indicated by the broken line. At this time, the guide unit 46 is held by the holding surface of the connecting member 50 in a state in which the guide unit 46 opens the first feeding passage 44, so that the sheet processing device 33 is in the jam clearance position where the first feeding passage 44 is opened as shown in FIG. 20 and part (a) of FIG. 21.

In the case where the guide unit 46 is singly closed from this state, when the guide unit 46 is pressed down, a force is applied from the link shaft 49 to the holding surface 72 of the connecting member 50 in a downward direction. As described above, the holding surface 72 is the surface inclined from the one side toward the other side with respect to the widthwise direction perpendicular to the sheet feeding direction. For this reason, when the force is applied from the link shaft 49 to the holding surface 72 in the downward direction, the holding surface is swung clockwise as shown by an arrow Y2 indicated by the broken line. As a result, connection between the link shaft 49 and the connecting member 50 is released, so that the guide unit 46 can be closed singly. That is, the guide unit 46 can be disconnected from the connecting member 50 by only being pressed down from the state in which the first feeding passage 44 is opened during the jam clearance, so that the guide unit 46 can be closed. Incidentally, the closed guide unit 46 is held in the image forming apparatus by a toggle mechanism in a state in which the feeding passage is closed.

On the other hand, when the sheet processing device 33 is moved from the jam clearance position where the link shaft 49 is held by the holding surface 72, in a direction in which the sheet processing device 33 is further moved shaft the operation position, the link shaft 49*a* falls off the holding surface 72 and is disconnected from the connecting member 50. For that reason, the sheet processing device 33 can be dismounted without performing an operation such that connection between the guide unit 46 and the sheet processing device 33 is independently eliminated.

[Connecting Mechanism of Sheet Processing Device with Guide Unit]

Next, using FIG. 25 and FIG. 26, an opening and closing operation of the feeding passage by the swing operation of the guide unit 46, and the toggle mechanism will be described.

FIG. 25 and FIG. 26 are partially perspective views showing a rear side holding portion of the guide unit 46 of the image forming apparatus. FIG. 25 shows a state in which the guide unit 46 is closed, and FIG. 26 shows a state in which the guide unit 46 is opened. Here, the rear side of the image forming apparatus refers to the one side with respect to the widthwise direction perpendicular to the sheet feeding direction and is the rear side (rear surface side) of the image forming apparatus positioned on a side opposite from a front side in the case where a front side of FIG. 20 is the front side of the image forming apparatus.

As shown in FIG. 25 and FIG. 26, a rear side plate 47 constitutes a rear-side frame of the discharge portion. The upper roller 31*a* and the lower roller 31*b* constituting the discharging roller pair 31 are rotatably supported by the rear side plate 47 through bearings 55 and 56, respectively. The guide unit 46 including the one feeding guide constituting the feeding passage is rotatably supported by the rear side plate 47 about the rotation shaft of the lower roller 31*a* rotatably supported by the bearing 56. The rear side plate 47 includes, as shown in FIG. 25, an abutment portion 61 for abutting the link shaft 49 which is an engaging portion of the guide unit 46.

A toggle plate 58 which is a toggle member is provided swingable relative to the rear side plate 47 with a caulking pin 64 as a supporting point. A toggle spring 57 is connected between the toggle plate 58 and the rear side plate 47, so that a tensile force of the toggle spring 57 acts on the toggle plate 58. The toggle plate 58 is pressed by the tensile force of the toggle spring 57 and includes a pressing portion 60 for abutting the link shaft 49 of the guide unit 46 against the abutment portion 61.

The guide unit 46 is held so that the link shaft 49 thereof is sandwiched between the pressing portion 60 of the toggle plate 58 pressed by the tensile force of the toggle spring 57 and the abutment portion 61 of the rear side plate 47. As a result, the guide unit 46 is positioned relative to the image forming apparatus as shown in FIG. 1 and part (a) of FIG. 21.

Further, the rear side plate 47 includes a second abutment portion 62 against which the toggle plate 58 abuts as shown in FIG. 26. As shown in FIG. 26, with rotation of the guide unit 46, the link shaft 49 is moved in an arrow Y4 direction against a pressing force of the target spring 57, so that the pressing portion 60 of the toggle plate 58 is pressed and thus holding of the guide unit 46 by the toggle plate 58 is released. At this time, the toggle plate 58 swings the link shaft 49 from a holding position shown in FIG. 25 toward a stand-by position shown in FIG. 25 via a neutral position by the tensile force of the toggle spring 57 with the caulking pin 64 as the supporting point. Then, the toggle plate 58 abuts against the second abutment portion 62 of the rear side plate 47 by the tensile force of the toggle spring 57 and stops at the stand-by position where the toggle plate 58 attracts the link shaft 49.

Next, using FIG. 27 and FIG. 28, a connecting operation of the connecting member 50 with the slide operation of the sheet processing device and interrelation of the opening and closing operation of the guide unit 46 will be described.

Parts (a), (b) and (c) of FIG. 27 are partially schematic views showing only a periphery of the guide unit 46, and the fixing wall 51 and the moving wall 53 which constitute the groove portion 52 of the connecting member 50 of the sheet processing device. Parts (a), (b) and (c) of FIG. 27 show an operation in which the feeding passage is opened from a state that the connecting member 50 positionally holds the guide unit 46 with the slide operation of the sheet processing device from the operation position to the retracted position.

The guide unit 46 is positionally held as shown in part (a) of FIG. 27 by abutting the link shaft 49 against the abutment portion 61 of the rear side plate 47 by the pressing portion 60 pressed by the toggle spring 57 acting on the toggle plate 58. At this time, the fixing wall 51 and the moving wall 53 of the connecting member do not contact the link shaft 49. That is, the link shaft 49 of the guide unit 46 is not in contact with the moving wall 53 and the fixing wall 51 of the connecting member of the sheet processing device being in the operation position in a state in which the link shaft 49 is sandwiched and held by the pressing portion 60 of the toggle plate 58 and the abutment portion 61 of the rear side plate 47. For this reason, the position of the guide unit 46 is determined by the rear side plate 47 and the toggle plate 58 with accuracy.

When the sheet processing device is slid (moved) is moved from the position (operation position) shown in part (a) of FIG. 27 toward the retracted position, the moving wall 53 of the connecting member above against the link shaft 49, and this link shaft 49 acts on the pressing portion 60 of the toggle plate 58 in a rightward direction in the figure and swings the toggle plate 58. With movement of the sheet processing device, the link shaft 49 of the guide unit 46 is swung over the neutral position of the force from the holding position of the link shaft 49 shown in part (a) of FIG. 27 and abuts against the second abutment portion 62 of the rear side plate 47. As a result, the toggle plate 58 is stopped at the stand-by position shown in part (b) of FIG. 27 where the toggle plate 58 attracts the link shaft 49 of the guide unit 46. In a state shown in part (b) of FIG. 27, the toggle plate 58 moves to a position where the toggle plate 58 does not obstruct a movement locus of the link shaft 49 for opening the guide unit 46.

With further movement of the sheet processing device from the position shown in part (b) of FIG. 27, the link shaft 49 of the guide unit 46 is guided by the moving wall 53 of the connecting member 50 and is swung about the bearing 56 as the supporting point, so that the link shaft 49 is in a state in which the feeding passage is opened as shown in part (c) of FIG. 27. As shown in part (c) of FIG. 27, the link shaft 49 is held by the connecting member 50, so that the guide unit 46 is held at the jam clearance position where the feeding passage is opened. At this time, the link shaft 49 of the guide unit 46 is held by the holding surface 72 of the connecting member 50 as shown by a broken line 49*a* in part (c) of FIG. 24. As a result, the swingable member 66 is moved about the supporting point shaft 69 in the arrow Y2 direction by pressing down the guide unit 46, so that the holding surface 72 is retracted and thus holding of the link shaft 49 by the holding surface 72 is released. As a result, separately from the slide operation of the sheet processing device, the guide unit can be manually closed independently, so that improvement in operativity and application of a force more than necessary, to the guide unit and the connecting member can be prevented.

When the sheet processing device is dismounted from the image forming apparatus, the sheet processing device is further moved from the position shown in part (c) of FIG. 27. That is, the sheet processing device is moved in a direction of being further away from the retracted position being away from the discharge portion. As a result, the link shaft 49 of the guide unit 46 passes through the holding surface 72 of the connecting member 50, so that the sheet processing device becomes dismountable.

Thus, only by pulling out the sheet processing device by sliding the sheet processing device relative to the image forming apparatus, the connecting member 50 acts on the link shaft 49 of the guide unit 46 and moves the guide unit 46, so that the feeding passage can be opened. Further, only by pulling out the sheet processing device through the sliding, connection of the sheet processing device with the guide unit can be released.

Using parts (a), (b) and (c) of FIG. 28, an operation of moving the guide unit 46 to a sheet feedable position by being closed from the opened state will be described. Part (a) of FIG. 28 shows the same state as part (c) of FIG. 27 and shows a state in which the guide unit 46 opens the feeding passage for the jam clearance.

When the sheet processing device is moved toward the operation position from the position shown in part (a) of FIG. 28, the link shaft 49 descends along the moving wall 53 of the connecting member by the swing operation of the guide unit 46. Thereafter, with the movement of the sheet processing device, the link shaft 49 above against the fixing wall 51 opposing the moving wall 53 with respect to the movement direction of the sheet processing device. Thereafter, with the movement of the sheet processing device, the fixing wall 51 of the connecting member pushes the link shaft 49, so that the link shaft 49 contacts a pressing portion 63 of the toggle plate 58 which is at rest in the stand-by position as shown in part (b) of FIG. 28.

When the sheet processing device is further moved from the position shown in part (b) of FIG. 28, the link shaft 49 pushed by the fixing wall 51 of the connecting member pushes the pressing portion 63 of the toggle plate 58, so that the toggle plate 58 starts swing about a pin 64 as the supporting point toward the holding position. When the toggle plate 58 is swung over the neutral position of the force by the link shaft 49, the tensile force of the toggle spring 57 acts in a direction toward the holding position. By this action of the toggle spring 57, the pressing portion 60 of the toggle plate 58 contacts the link shaft 49 and presses the link shaft 49 in the direction toward the holding position, so that the link shaft 49 is abutted against the abutment portion 61 of the rear side plate 47. As a result, as shown in part (c) of FIG. 28, the link shaft 49 is abutted against the abutment portion 61 of the rear side plate 47 by the pressing portion 60 pressed by the toggle spring 57 acting on the toggle plate 58. At this time, the fixing wall 51 and the moving wall 53 of the connecting member do not contact the link shaft 49. That is, the link shaft 49 of the guide unit 46 is in non-contact with the moving wall 53 and the fixing wall 51 of the connecting member of the sheet processing device being the operation position in a state in which the link shaft 49 is sandwiched and held by the pressing portion 60 of the toggle plate 58 and the abutment portion 61 of the rear side plate 47. For this reason, the position of the guide unit 46 is accurately determined by the rear side plate 47 and the toggle plate 58.

Thus, by only sliding and inserting the sheet processing device into the image forming apparatus, the connecting member 50 acts on the link shaft 49 of the guide unit 46 and moves the link shaft, so that the feeding passage can be closed. Further, although only the sheet processing device is slid (moved), the link shaft 49 can be interrelated with the toggle mechanism provided on the image forming apparatus main assembly side. As a result, the link shaft 49 can be held by a component part provided on the image forming apparatus main assembly side, so that the guide unit 46 can be accurately held.

As described above, according to this embodiment, the connecting member mountable to and dismountable from the feeding unit in the image forming apparatus is provided to the sheet processing device which is slidable (movable). As a result, only by pulling out the sheet processing device through sliding of the sheet processing device relative to the image forming apparatus, the guide unit is rotated and the feeding passage is opened, and thereafter, the guide unit and be held in the state in which the feeding passage is opened. Further, only be sliding and inserting the sheet processing device into the image forming apparatus, the guide unit is rotated and the feeding passage is closed. As a result, operativity during the jam clearance can be improved. Further, when the sheet processing device is dismounted from the image forming apparatus, only by pulling out the sheet processing device through sliding the connection thereof with the guide unit can be released, so that the mounting and dismounting of the sheet processing device can be facilitated.

Further, irrespective of the movement of the sheet processing device, relative to the image forming apparatus, the guide unit held in the closed state can be manually closed independently. Further, only by sliding and inserting the sheet processing device into the image forming apparatus, the sheet processing device is connected again with the guide unit which has been disconnected therefrom, so that the feeding passage can be closed. As a result, the operativity during the jam clearance is further improved.

Other Embodiments

In the above-described embodiments, the four process cartridges constituting the image forming portion are used, but the number of use of the process cartridges is not limited, but may only be required to be appropriately set as needed.

Further, in the above-described embodiments, as the process cartridge mountable in and dismountable from the image forming apparatus, the process cartridge in which the photosensitive drum and, as the process means actable on the photosensitive drum, the charging means, the developing means and the cleaning means are integrally assembled into a unit was described as an example. However, the process cartridge is not limited thereto. A process cartridge integrally including, in addition to the photosensitive drum, any one of the charging means, the developing means and the cleaning means may also be used.

Further, in the above-described embodiments, as the image forming apparatus, the copying machine was described as an example, but the present invention is not limited thereto. For example, other image forming apparatuses such as a printer, a facsimile apparatus and a multifunction machine having functions of these machines may also be used. Further, the image forming apparatus in which the intermediary transfer member is used and the toner images of the respective colors are successively transferred superposedly onto the intermediary transfer member and then are collectively transferred from the intermediary transfer member onto the sheet was described as an example, but the image forming apparatus is not limited thereto. An image forming apparatus in which a sheet carrying member is used and the toner images of the respective colors are successively transferred superposedly onto the sheet carried on the sheet carrying member may also be used. Of these image forming apparatuses, by applying the present invention to the image forming apparatus in which the stacking portion or the sheet processing device are provided so as to be slidable (movable), a similar effect can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2018-197222 filed on Oct. 19, 2018 and 2018-197223 filed on Oct. 19, 2018, which are hereby incorporated by reference herein in their entirety.

What is claimed is:

1. An image forming apparatus comprising:

an image forming portion including an image bearing member and a transfer member, the transfer member being configured to form, onto a sheet, an image on the image bearing member;

a feeding portion including a rotation member configured to feed the sheet onto which the image is formed by the image forming portion;

a stacking portion including a stacking tray configured to stack the sheet discharged from said feeding portion and a sheet feeding passage along which the sheet fed from said feeding portion is fed, and movable between a first position where the sheet fed from said feeding portion is feedable to said sheet feeding passage and a second position away from the first position; and a movable member movable to a space between said feeding portion and said stacking portion, wherein movement of said stacking portion from the first position to the second position generates the movement of said movable member, and wherein said stacking portion includes (a) a sheet guide provided below said stacking tray and configured to guide the sheet sent from said feeding portion, (b) a sheet processing device provided below said sheet guide and configured to process the sheet, and (c) a second stacking tray configured to stack the processed sheet.

2. An image forming apparatus according to claim 1, wherein said movable member is provided to be rotatable relative to said image forming apparatus, and includes (a) a rotation supporting point above an end portion of said stacking portion with respect to a sheet feeding direction and (b) an engaging pin, engaged with said stacking portion, below the stacking portion end portion, and wherein, in coordination with the movement of said stacking portion from the first position to the second position, said movable member moves about said rotation supporting point such that an engaging pin side of said movable member moves in a direction from below the stacking portion end portion toward above the stacking portion end portion.

3. An image forming apparatus according to claim 2, wherein said stacking portion includes a guiding portion engageable with said movable member and configured to, with the movement of said stacking portion from the first position to the second position, guide said movable member to move about said rotation supporting point so that the engaging pin side of said movable member moves in a direction from below the stacking portion end portion toward above the stacking portion end portion.

4. An image forming apparatus according to claim 3, wherein said engaging pin of said movable member and said guiding portion of said stacking portion are provided outside a sheet feeding region with respect to a widthwise direction perpendicular to the sheet feeding direction.

5. An image forming apparatus according to claim 2, wherein said movable member is a guide unit including one guide of a plurality of guides forming a feeding passage for guiding the sheet in said feeding portion, and said one guide is rotated in a direction of being away from another guide of the plurality of guides so as to open said feeding passage in interrelation with the movement of said stacking portion from the first position to the second position.

6. An image forming apparatus according to claim 2, wherein said movable member is provided to be rotatable relative to said stacking portion so that one end portion thereof is rotatable relative to an end portion of said stacking portion on an upstream side of said stacking portion with respect to a sheet feeding direction and so that a bent portion against which the end portion of said stacking portion on the upstream side is to be abutted is provided at the other end portion thereof.

7. An image forming apparatus according to claim 6, wherein said movable member at one end portion thereof moves about a rotation center so that a bent portion side of said movable member moves in a direction from below the upstream-side end portion of said stacking portion toward above the upstream-side end portion of said stacking portion.

8. An image forming apparatus according to claim 6, wherein said movable member includes an engaging pin, and wherein said image forming apparatus includes a guiding portion engageable with said engaging pin of said movable member and configured to guide said movable member, with movement of said stacking portion from an operation position to a retracted position, so that a bent portion side of said movable member rotates about a rotation center.

9. An image forming apparatus according to claim 8, wherein said engaging pin of said movable member and said guiding portion of said image forming apparatus are provided outside a sheet feeding region with respect to a widthwise direction perpendicular to the sheet feeding direction.

10. An image forming apparatus according to claim 9, further comprising a latch provided below said guiding portion of said image forming apparatus so as to be movable in the widthwise direction perpendicular to the sheet feeding direction and urged toward said stacking portion with respect to the widthwise direction, and wherein said latch is movable between a holding position where one guide of a plurality of guides forming a feeding passage for guiding the sheet in said feeding portion is held at an open position where the feeding passage is opened and a retracted position where holding of said one guide held at the open position is released.

11. An image forming apparatus according to claim 10, wherein said latch includes a first inclined surface capable of moving said one guide in the widthwise direction in contact with said one guide against an urging force when said one guide is rotated from a position where said one guide opposes another guide of the plurality of guides and forms the feeding passage toward the holding position, and said latch holds, at the holding position, said one guide passed through said first inclined surface.

12. An image forming apparatus according to claim 11, wherein said latch includes a second inclined surface capable of moving said stacking portion in the widthwise direction in contact with said stacking portion against the urging force when said stacking portion is moved from the second position toward the first position, and said latch moves in the widthwise direction against the urging force by contact with said stacking portion and releases holding of said one guide.

13. An image forming apparatus according to claim 1, wherein said feeding portion includes (a) a discharging roller pair provided above said stacking portion with respect to a vertical direction and configured to discharge the sheet on said stacking portion and (b) a guide configured to form a feeding passage for guiding the sheet to said discharging roller pair, wherein said image forming apparatus includes a supporting wall provided below said discharging roller pair and extending from a sheet stacking surface of said stacking portion to immediately below said discharging roller pair, said supporting wall being configured to support an upstream side end portion of the sheet with respect to a sheet feeding direction, wherein said supporting wall comprises a first supporting wall and a second supporting wall which are vertically divided supporting walls in a vertical direction, wherein said first supporting wall is provided on an upper side with respect to the vertical direction and provided on one guide of a plurality of guides forming the feeding passage, and wherein said second supporting wall is provided on a lower side with respect to the vertical direction and provided at an upstream side end portion of said stacking portion with respect to the sheet feeding direction.

14. An image forming apparatus according to claim 13, further comprising a detecting flag provided rotatable relative to said image forming apparatus and configured to detect passing of the sheet through said discharging roller pair and a height of the sheet stacked on said stacking portion, wherein a divided position of said first supporting wall and said second supporting wall is below a free end of said detecting flag with respect to the vertical direction.

15. An image forming apparatus according to claim 13, wherein with respect to the sheet feeding direction, a sheet end portion restricting surface of said first supporting wall is positioned upstream of an outer peripheral surface of a lower roller of said discharging roller pair, and a sheet end portion restricting surface of said second supporting wall is positioned upstream of the sheet end portion restricting surface of said first supporting wall.

16. An image forming apparatus according to claim 1, wherein said stacking portion is provided immediately above said image forming portion, and wherein said image forming apparatus further comprises an image reading portion provided immediately above said stacking portion and above said feeding passage and configured to read an image of an original.

17. An image forming apparatus comprising:

an image forming portion including an image bearing member and a transfer member, the transfer member being configured to form, onto a sheet, an image on the image bearing member;

a feeding portion provided to be rotatable and which includes a guide unit including a one guide of a plurality of guides forming a first feeding passage for guiding the sheet and includes a discharging roller pair configured to discharge the sheet guided by said one guide; and a stacking portion including a connecting portion connected so as to be mountable to and dismountable from said guide unit, a stacking tray configured to stack the sheet discharged by said feeding portion and a second feeding passage along which the sheet fed from said feeding portion is fed, and movable between a first position where the sheet feed from said feeding portion is feedable to said second feeding passage and a second position away from the first position, wherein said connecting portion rotates said guide unit in a direction in which said guide unit moves away from another guide of the plurality of guides, said another guide opposing said one guide, with an operation of moving said stacking portion from the first position to the second position, wherein said connecting portion is provided at one end portion with respect to a widthwise direction perpendicular to a sheet feeding direction.

18. An image forming apparatus according to claim 17, wherein said stacking portion is movable to a third position that is further, in a direction away from said feeding portion, from the first position than the second position, and wherein said connecting portion releases connection thereof with said guide unit when said stacking portion is moved in a direction in which said stacking portion is moved further away from the second position.

19. An image forming apparatus according to claim 17, wherein said guide unit includes an engaging portion engageable with said connecting portion so as to be mountable to and dismountable from said connecting portion, wherein said connecting portion including a moving portion provided movable relative to said stacking portion in a widthwise direction relative to a sheet feeding direction, and wherein said moving portion includes a first acting surface which is a surface crossing a direction in which said stacking portion moves and which acts on said engaging portion so as to rotate said guide unit in a direction of moving away from said another guide opposing said one guide with an operation of moving said stacking portion from the first position to the second position, and includes a holding surface which is a surface following a direction in which said stacking portion moves and which is configured to hold said engaging portion with respect to a direction of gravitation so that said guide unit is held in a state in which said first feeding passage is opened.

20. An image forming apparatus according to claim 19, wherein said holding surface holds said engaging portion so that said stacking portion is movable from the second position in a direction further away from the first position.

21. An image forming apparatus according to claim 19, wherein said holding surface is a surface inclined from one side toward the other side with respect to the widthwise direction, and when a force of rotating said guide unit, held in a state in which said first feeding passage is opened, in a direction in which said guide unit approaches said another guide opposing said one guide is applied to said guide unit, said moving portion is moved from said the other side toward said one side with respect to the widthwise direction by said engaging portion through said holding surface and releases holding of said engaging portion.

22. An image forming apparatus according to claim 19, wherein said connecting portion includes a fixing portion (a) provided opposed to said moving portion in the direction from the first position to the second position in which said stacking portion moves and (b) configured to be fixed to said stacking portion, and wherein said fixing portion includes a second acting surface which is a surface crossing the direction from the first position to the second position in which said stacking portion moves, which is provided opposed to said first acting surface of said moving portion, and which acts on said engaging portion so as to rotate said guide unit in a direction of moving toward said another guide opposing said one guide with an operation of said stacking portion from the second position to the first position.

23. An image forming apparatus according to claim 19, wherein said moving portion includes an inclined surface which is provided below said holding surface and on a side downstream of said first acting surface with respect to a direction in which said stacking portion is moved from the second position to the first position and which is inclined downwardly toward the side downstream of said first acting surface, and wherein with an operation of moving said stacking portion from the second position to the first position, said moving portion is moved from said the other side toward said one side with respect to the widthwise direction by engagement of said inclined surface with said engaging portion of said guide unit disconnected from said stacking portion, and said moving portion is moved from said one side toward said the other side with respect to the widthwise direction by disengagement of said inclined surface from said engaging portion, and then said connecting portion is connected to said guide unit again.

24. An image forming apparatus according to claim 19, further comprising:

a side plate rotatably supporting said guide unit and including an abutting portion against which said engaging portion of said guide unit abuts and which constitutes a frame, and a toggle member including a pressing portion configured to cause said engaging portion of said guide unit to abut against said abutting portion, which is provided swingable relative to said side plate, and on which a tensile force of a spring acts, wherein said guide unit is positioned in said image forming apparatus by sandwiching and holding said engaging portion of said guide unit between said abutting portion of said side plate and said pressing portion of said toggle member pressed by the tensile force of the spring.

25. An image forming apparatus according to claim 24, wherein said side plate includes a second abutting portion against which said toggle member abuts, and wherein with the operation of moving said stacking portion from the first position to the second position, when said connecting portion rotates said guide unit in the direction of moving away from said another guide opposing said one guide, said toggle member is swung by said engaging portion of said guide unit rotated by said connecting portion and abuts against said second abutting portion and then stops at a stand-by position where said toggle member attracts said engaging portion thereto.

26. An image forming apparatus according to claim 24, wherein said engaging portion of said guide unit is in non-contact with said connecting portion of said stacking portion, being in the first position, in a state in which said engaging portion is sandwiched held between said pressing portion of said toggle member and said abutting portion of said side plate.

* * * * *